US009158275B2

(12) United States Patent
Inami et al.

(10) Patent No.: US 9,158,275 B2
(45) Date of Patent: Oct. 13, 2015

(54) BLOWER PIPE, BLOWING DEVICE, AND IMAGE FORMING APPARATUS

(71) Applicant: FUJI XEROX CO., LTD., Tokyo (JP)

(72) Inventors: Kazuki Inami, Kanagawa (JP); Yasunori Momomura, Kanagawa (JP); Yuki Nagamori, Kanagawa (JP); Koji Otsuka, Kanagawa (JP); Masafumi Kudo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/964,875

(22) Filed: Aug. 12, 2013

(65) Prior Publication Data

US 2014/0119767 A1 May 1, 2014

(30) Foreign Application Priority Data

Oct. 31, 2012 (JP) ..... 2012-240275

(51) Int. Cl.
*G03G 21/20* (2006.01)
*G03G 15/02* (2006.01)

(52) U.S. Cl.
CPC ..... *G03G 21/206* (2013.01); *G03G 15/0291* (2013.01); *G03G 2215/027* (2013.01); *G03G 2221/1645* (2013.01)

(58) Field of Classification Search
CPC ..... G03G 21/206
USPC ..... 399/91–92; 454/192, 287; 34/640
See application file for complete search history.

(56) References Cited

U.S. PATENT DOCUMENTS

| | | | | |
|---|---|---|---|---|
| 3,065,684 | A * | 11/1962 | O'Day | 454/297 |
| 5,612,768 | A * | 3/1997 | Kim et al. | 399/92 |
| 8,369,734 | B2 * | 2/2013 | Shimizu et al. | 399/100 |
| 2011/0121510 | A1 * | 5/2011 | Tsuda et al. | 271/226 |
| 2012/0045243 | A1 * | 2/2012 | Nishikawa et al. | 399/92 |
| 2013/0108307 | A1 * | 5/2013 | Katahira et al. | 399/92 |

FOREIGN PATENT DOCUMENTS

| | | | |
|---|---|---|---|
| JP | 10198128 | A * | 7/1998 |
| JP | A-10-198128 | | 7/1998 |
| JP | 2006071701 | A * | 3/2006 |

* cited by examiner

*Primary Examiner* — Clayton E Laballe
*Assistant Examiner* — Leon W Rhodes, Jr.
(74) *Attorney, Agent, or Firm* — Oliff PLC

(57) ABSTRACT

A blower pipe includes an inlet port, an outlet port, a flow path that connects the inlet port and the outlet port and is bent at least in one location, and plural flow control members that are provided in mutually different regions in a direction in which air in the flow path is caused to flow and that control the flow of the air, wherein a flow control member of the plural flow control members closest to the inlet port (a) cuts off a portion of a bent portion of the flow path while air crossing the portion, (b) makes an elongated gap to pass air, and (c) satisfies following condition; when a virtual straight line which passes through both end portions of the elongated gap is drawn, the virtual straight line lies downstream of an extension line of a wall immediately before the flow path is bent.

18 Claims, 24 Drawing Sheets

BLOWER PIPE, BLOWING DEVICE, AND IMAGE FORMING APPARATUS

CROSS-REFERENCE TO RELATED APPLICATIONS

This application is based on and claims priority under 35 USC 119 from Japanese Patent Application No. 2012-240275 filed Oct. 31, 2012.

BACKGROUND (i) Technical Field

The present invention relates to a blower pipe, a blowing device, and an image forming apparatus.

(ii) Related Art

In image forming apparatuses that form an image constituted by a developer on recording paper, for example, there is an image forming apparatus using a corona discharger that performs corona discharge in the process of charging a latent image holding member, such as a photoreceptor or the process of neutralization, the process of transferring a non-fixed image to the recording paper, or the like.

Additionally, in the corona discharger, in order to prevent unnecessary substances, such as paper debris or a discharge product, from adhering to component parts, such as a discharge wire or a grid electrode, a blowing device that blows air against the component parts may be provided together. The blowing device in this case is generally constituted by a blower that sends air, and a duct (blower pipe) that guides and sends out the air sent from the blower up to a target structure, such as a corona discharger.

In the related art, improvements for enabling air to be uniformly blown in the longitudinal direction of the component parts, such as a discharge wire, are variously performed on the blowing device or the like. Particularly, as such a blowing device or the like, there is proposed a blowing device that does not adopt a configuration in which the shape of a passage space of a duct through which air is caused to flow is formed in a special shape or a configuration in which a straightening vane or the like that adjusts the direction in which air flows is installed in the passage space of the duct, but adopts a separate configuration as illustrated below.

SUMMARY

According to an aspect of the invention, there is provided a blower pipe including: an inlet port that takes in air; an outlet port that has an elongated opening shape that is parallel to a longitudinal portion of an elongated target structure in a longitudinal direction and is arranged to face the longitudinal portion of the elongated target structure in the longitudinal direction against which the air taken in from the inlet port is to be blown and is different from the opening shape of the inlet port; a flow path that connects the inlet port and the outlet port to cause air to flow therethrough and is bent at least in one location; and plural flow control members that are provided in mutually different regions in a direction in which air in the flow path is caused to flow and that control the flow of the air, wherein a flow control member of the plural flow control members closest to the inlet port (a) cuts off a portion of a bent portion of the flow path while air crossing the portion, (b) makes an elongated gap extending in the longitudinal direction to pass air, and (c) satisfies following condition; when a virtual straight line which passes through both end portions of the elongated gap in the longitudinal direction is drawn, the virtual straight line lies downstream of an extension line of a wall immediately before the flow path is bent, in a flow direction of air that flows through the bent passage portion.

BRIEF DESCRIPTION OF THE DRAWINGS

Exemplary embodiments of the present invention will be described in detail based on the following figures, wherein:

FIG. 1 is an explanatory view showing the outline of an image forming apparatus using a blowing device according to Exemplary Embodiment 1 or the like;

DETAILED DESCRIPTION

The modes (simply referred to as "exemplary embodiments") for carrying out the invention will be described below in detail with reference to the accompanying drawings.

Exemplary Embodiment 1

Figure 1:
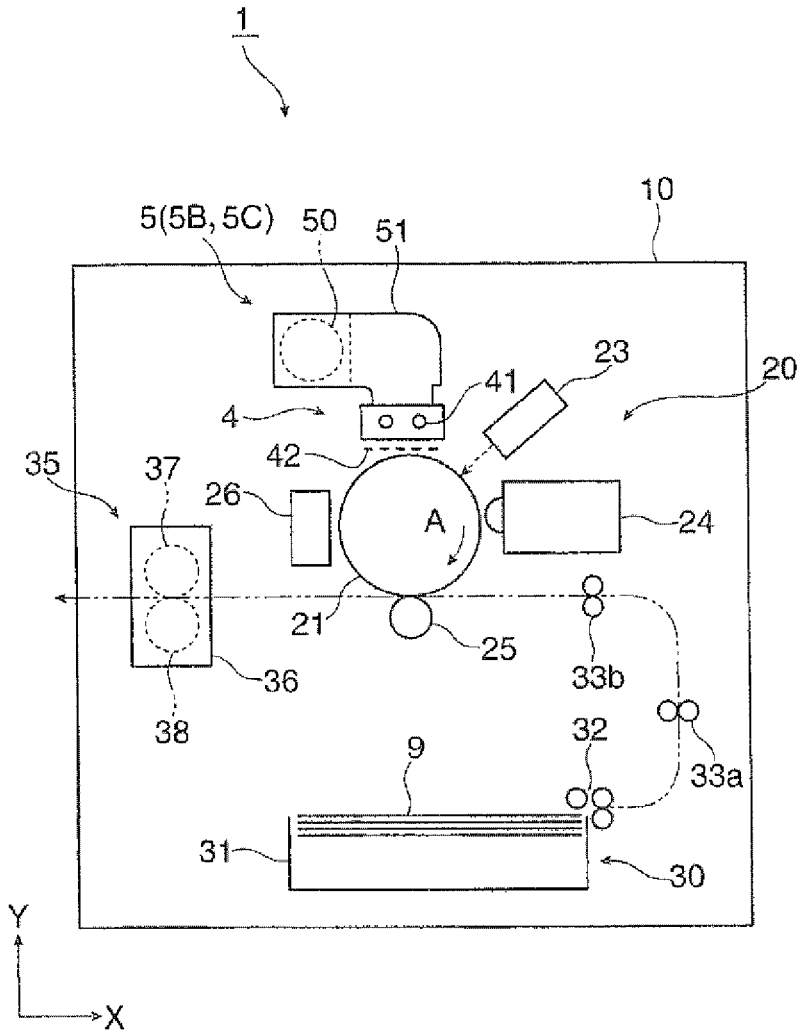
Figure 2:
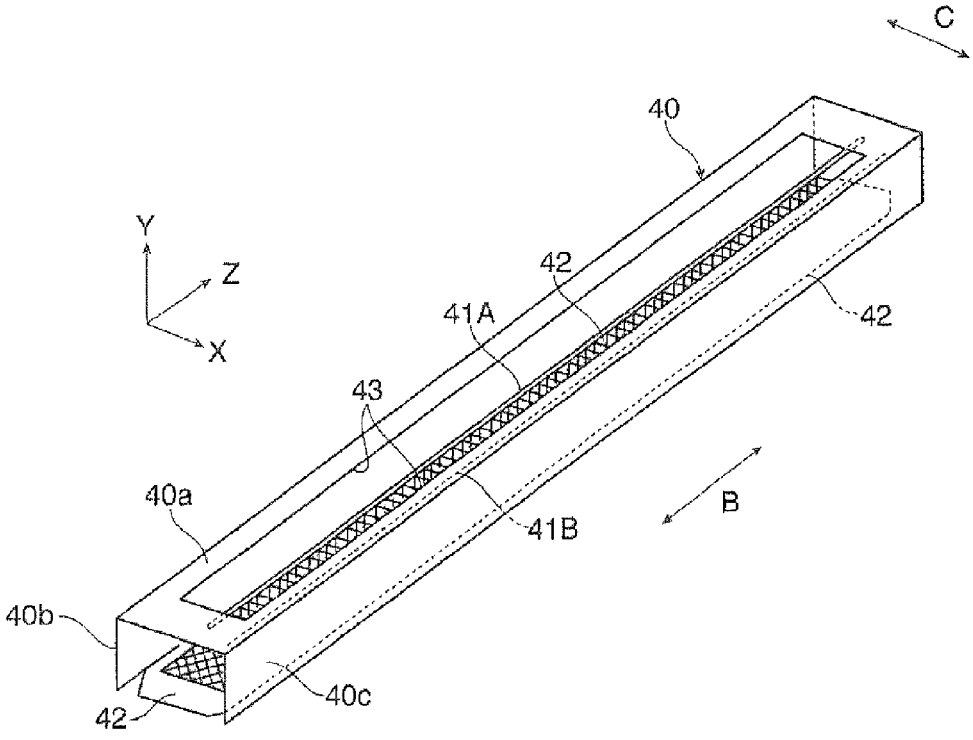
FIG. 2 is a schematic perspective view showing the charging device including a corona discharger provided in the image forming apparatus of FIG. 1.
Figure 3:
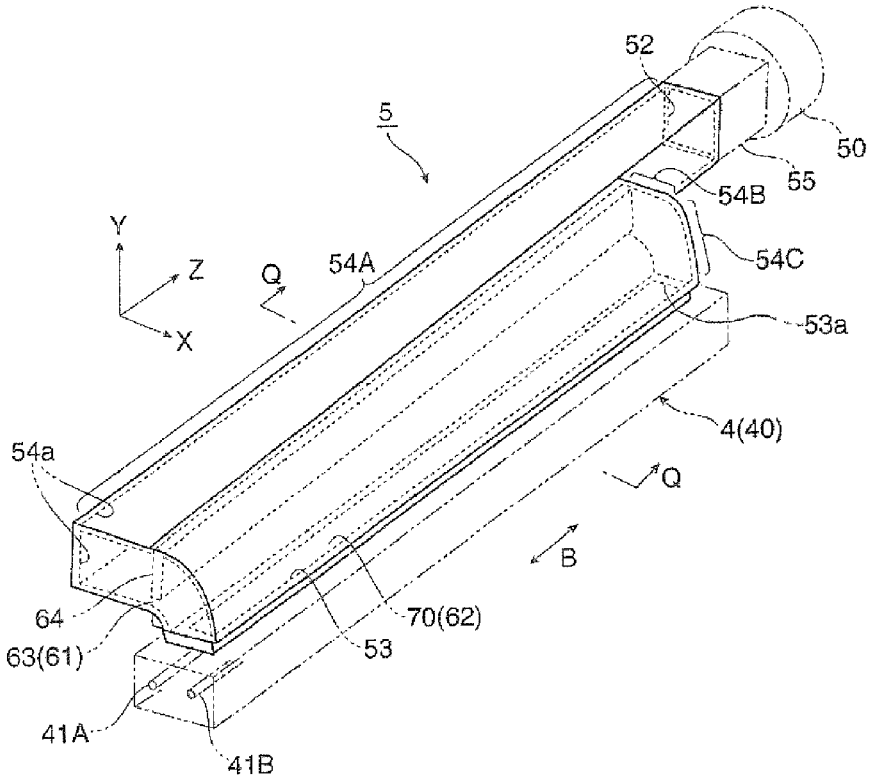
FIG. 3 is a schematic perspective view showing the outline of a blowing device to be applied to the charging device of FIG. 2.

FIGS. 1 to 3 show a blower pipe and a blowing device and an image forming apparatus using the same according to Exemplary Embodiment 1. FIG. 1 shows the outline of the image forming apparatus, FIG. 2 shows the charging device as an elongated target structure that is used for the image forming apparatus, and against which air is blown by the blower pipe or the blowing device, and FIG. 3 shows the outline of the blower pipe or the blowing device.

In the image forming apparatus 1, as shown in FIG. 1, an image forming unit 20 that forms a toner image constituted by toner as a developer to transfer the toner image to a sheet 9 as an example of a recording material, a sheet feeder 30 that accommodates and transports sheets 9 to be supplied to the image forming unit 20, and a fixing device 35 that fixes the toner image formed by the image forming unit 20 on a sheet 9 are installed in an internal space of a housing 10 constituted by a support frame, a sheathing cover, or the like. Although only one image forming unit 20 is illustrated in Exemplary Embodiment 1, plural image forming units may be used.

The above image forming unit 20 is configured, for example utilizing a well-known electrophotographic system, and is mainly constituted by a photoconductor drum 21 that is rotationally driven in a direction (a clockwise direction in the drawing) indicated by arrow A, a charging device 4 that charges a peripheral surface that becomes an image formation region of the photoconductor drum 21 with required potential, an exposure device 23 that irradiates the surface of the photoconductor drum 21 after charging with light (dotted line with an arrow) based on image information (signal) input from the outside and forms an electrostatic latent image with a potential difference, a developing device 24 that develops the electrostatic latent image as a toner image with a toner, a transfer device 25 that transfers the toner image to a sheet 9, and a cleaning device 26 that removes the toner or the like that remains on the surface of the photoconductor drum 21 after transfer.

Among these, a corona discharger is used as the charging device 4. The charging device 4 including the corona discharger, as shown in FIG. 2 or the like, is constituted by a so-called scorotron type corona discharger including a shielding case (covering member) 40 with an external shape having an oblong top plate 40*a* of which a portion opens, and side plates 40*b* and 40*c* that hang downward from long side portions extending along a longitudinal direction B of the top plate 40*a*, two end supports (not shown) that are respectively attached to both ends (short side portions) of the shielding case 40 in the longitudinal direction B, two corona discharge wires 41A and 41B that are attached in a state where the wires pass through the internal space of the shielding case 40 and are stretched substantially in the shape of a straight line between these two end supports, and a grid-like grid electrode (electric field adjustment plate) 42 that is attached to a lower opening of the shielding case 40 in a state where the electrode covers the lower opening and is present between the corona discharge wires 41 and the peripheral surface of the photoconductor drum 21. Reference numeral 40*d* shown in FIG. 4 or the like represents a partition wall that partitions the space where the two corona discharge wires 41A and 41B are arranged.

Additionally, the charging device 4 is arranged such that the corona discharge wires 41 (41A and 41B) are present at least in an image forming target region along the direction of a rotational axis of the photoconductor drum 21 in a state where the wires face each other at a predetermined interval (for example, a discharge gap) from the peripheral surface of the photoconductor drum 21. Additionally, the charging device 4 is adapted such that charging voltages are applied to the discharge wires 41 (between the wires and the photoconductor drum 21) from a power unit (not shown) when an image is formed.

Moreover, with the use of the charging device 4, substances (unnecessary substances), such as debris of a sheet 9, a discharge product generated by corona discharge, and external additives adhere to the corona discharge wires 41 or the grid electrode 42, and are contaminated, and the corona discharge is no longer sufficiently or uniformly performed. As a result, charging defects, such as uneven charging, may occur. For this reason, in order to prevent or keep unnecessary substances from adhering to the discharge wires 41 and the grid electrode 42, a blowing device 5 for blasting air against the discharge wires 41 and the grid electrode 42 is together provided at the charging device 4. Additionally, the top face 40*a* of the shielding case 40 of the charging device 4 is formed with an opening 43 for taking in the air from the blowing device 5. The opening 43 is formed so that the opening shape thereof becomes oblong. In addition, the blowing device 5 will be described below in detail.

The sheet feeder 30 includes a sheet accommodation member 31 of a tray type, a cassette type, or the like that accommodates plural sheets 9 including a required size, required kind, or the like to be used for formation of an image, in a stacked state, and a delivery device 32 that delivers the sheets 9 accommodated in the sheet accommodation member 31 one by one toward a transporting path. If the timing for sheet feeding comes, the sheets 9 are delivered one by one. Plural sheet accommodation members 31 are provided according to utilization modes. A one-dot chain line with an arrow in FIG. 1 shows a transporting path which a sheet 9 is mainly transported along and passes through. This transporting path for sheets is constituted by plural sheet transporting roll pairs 33*a* and 33*b*, a transporting guide member (not shown), or the like.

The fixing device 35 includes, inside a housing 36 formed with an introduction port and a discharge port through which a sheet 9 passes, a roll-shaped or belt-shaped heating rotary member 37 of which the surface temperature is heated to and maintained at a required temperature by a heating unit, and a roll-shaped or belt-shaped pressurizing rotary member 38 that is rotationally driven in contact with the heating rotary member at a required pressure so as to extend substantially along the direction of the rotational axis of the heating rotary member 37. The fixing device 35 allows a sheet 9 after a toner image is transferred to be introduced into and pass through a fixing treatment section formed between the heating rotary member 37 and the pressurizing rotary member 38.

Image formation by the image forming apparatus 1 is performed as follows. Here, a basic image forming operation when an image is formed on one side of a sheet 9 will be described as an example.

In the image forming apparatus 1, if the control device or the like receives a start command for an image forming operation, in the image forming unit 20, the peripheral surface of the photoconductor drum 21 that starts to rotate is charged with a predetermined polarity and potential by the charging device 4. At this time, in the charging device 4, corona discharge is generated in a state where charging voltages are applied to the corona discharge wires 41, and an electric field is formed between the discharge wires 41 and the peripheral surface of the photoconductor drum 21, and thereby, the peripheral surface of the photoconductor drum 21 is charged with required potential. In this case, the charging potential of the photoconductor drum 21 is adjusted by the grid electrode 42.

Subsequently, an electrostatic latent image, which is configured with a required potential difference as exposure is performed on the basis of image information from the exposure device 23, is formed on the peripheral surface of the charged photoconductor drum 21. Thereafter, when the electrostatic latent image formed on the photoconductor drum 21 passes through the developing device 24, the electrostatic latent image is developed with toner that is supplied from the developing roll 24*a* and charged with required polarity, and is visualized as a toner image.

Next, if the toner image formed on the photoconductor drum 21 is transported to a transfer position that faces the transfer device 25 by the rotation of the photoconductor drum 21, the toner image is transferred by the transfer device 25 to a sheet 9 to be supplied through a transporting path from the sheet feeder 30 according to this timing. The peripheral surface of each photoconductor drum 21 after this transfer is cleaned by the cleaning device 26.

Subsequently, the sheet 9 to which the toner image is transferred in the image forming unit 20 is transported so as to be introduced into the fixing device 35 after being peeled off from the photoconductor drum 21, and is heated and pressurized when passing in-between the heating rotary member 37 and the pressurizing rotary member 38 in the fixing device 35, whereby the toner image melts and is fixed on the sheet 9. The sheet 9 after this fixing is completed is ejected from the fixing device 35, and is transported and accommodated in an ejected sheet accommodation section (not shown) or the like that is formed, for example outside the housing 10.

A monochrome image constituted by a single-color toner is formed on one side of one sheet 9, and the basic image forming operation is completed. When there is an instruction for the image forming operation for plural sheets, a series of operations as described above are similarly repeated by the number of sheets.

Next, the blowing device 5 will be described.

The blowing device 5, as shown in FIG. 1, 3, or the like, includes a blower 50 that has a rotary fan that sends air, and a blower duct 51 that takes in the air sent from the blower 50 and guides and discharges the air up to the charging device 4 that is an object to be blown.

As the blower 50, for example, an axial flow type blower fan is used and the driving thereof is controlled so as to send a required volume of air. Additionally, the blower duct 51, as shown in FIGS. 3 to 6, is formed in a shape having an inlet 52 that takes in the air sent from the blower 50, an outlet 53 that is arranged in a state where the outlet faces the portion (the top face 40*a* of the shielding case 40), in the longitudinal direction B, of the elongated charging device 4 against which the air taken in from the inlet 52 is to be blown, and discharges the air so as to flow along a direction orthogonal to the longitudinal direction B, and a passage portion (body portion) 54 formed with a passage space 54*a* for connecting the inlet 52 and the outlet 53 to cause air to flow therethrough.

The passage portion 54 of the blower duct 51 has one end portion provided with the inlet 52 opened and has the other end portion closed, and the overall passage portion is constituted by an angular-tube-shaped introduction passage portion 54A formed so as to extend in the shape of a straight line along the longitudinal direction of the outlet 53 (the longitudinal direction B of the charging device 4), an angular-tube-shaped first bent passage portion 54B formed so as to extend after being substantially at a right angle to a substantially horizontal direction (direction substantially parallel to the coordinate axis X) in a state where the width of the passage space is increased from a region near the other end portion of the introduction passage portion 54A, and a second bent passage portion 54C formed so as to extend toward the charging device 4 after being bent in a downwardly perpendicular direction (direction substantially parallel to the coordinate axis Y) in a state where the width of the passage space remains equal from one end portion of the first bent passage portion 54B. A termination end of the second bent passage portion 54C is formed with an outlet 53 including an opening shape that is slightly narrower than the cross-sectional shape of the passage space of the termination end (however, the longitudinal length of the oblong shape is almost the same). The widths (dimensions along the longitudinal direction B) of both the passage spaces 54*a* of the first bent passage portion 54B and the second bent passage portion 54C are set to almost the same dimension.

Figure 4:
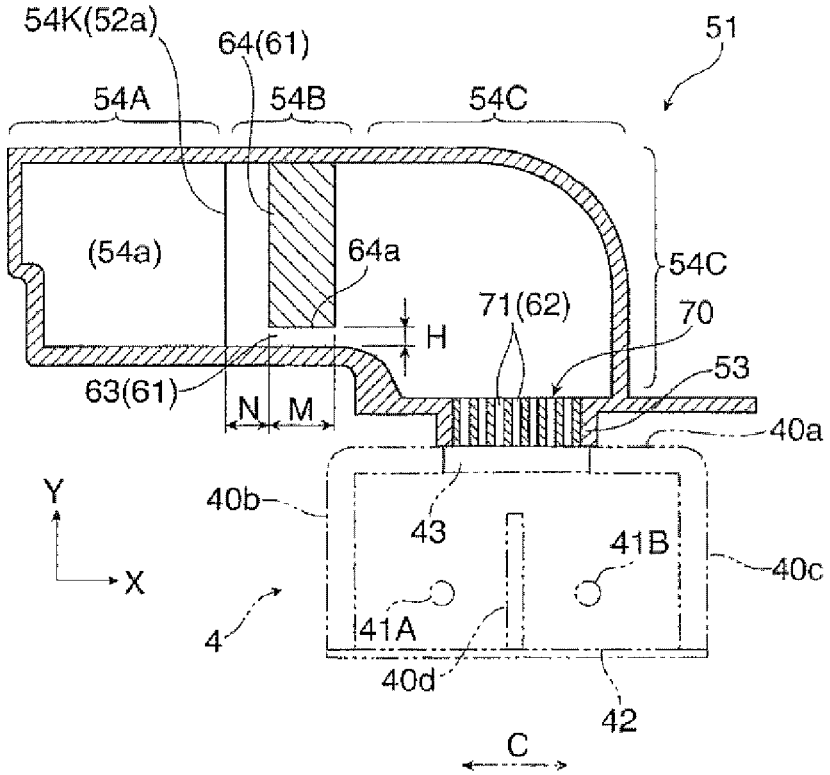
FIG. 4 is a cross-sectional view along line Q-Q of the blowing device (blower duct) of FIG. 3.
Figure 6:
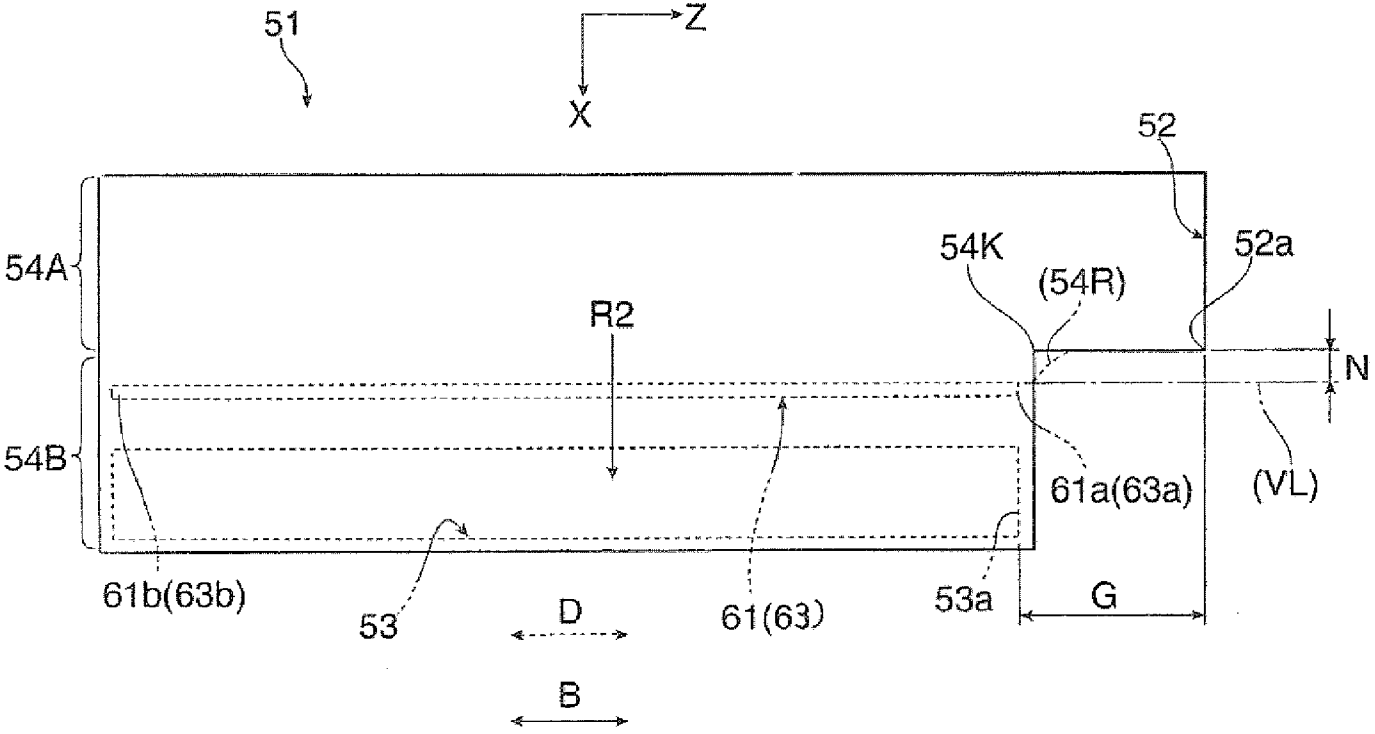
FIG. 6 is a schematic explanatory view showing the configuration of the blower duct of FIG. 3.

The inlet 52 of the blower duct 51 is formed so that the opening shape thereof becomes substantially square (FIGS. 3 and 4). A connection duct 55 for connecting between the blower duct and the blower 50 to send the air from the blower 50 up to the inlet 52 of the blower duct 51 attached to the inlet 52 (FIG. 3). On the other hand, the outlet 53 of the blower duct 51 is formed so that the opening shape thereof becomes an elongated opening shape (for example, oblong shape) parallel to the portion of the charging device 4 in the longitudinal direction B. For this reason, the blower duct 51 has the relationship where the inlet 52 and the outlet 53 are formed in mutually different opening shapes. In addition, even in a case where the inlet 52 and the outlet 53 have the same shape, when the inlet and the outlet are formed so as to have mutually different opening areas (when the inlet and outlet have a similar shape) is included in the relationship where the inlet and the outlet are formed in mutually different opening shapes. Additionally, the inlet 52, as shown in FIG. 6 or the like, is formed in a state where the inlet is present so as to protrude by a required dimension G further outward than one end portion 53*a* in the longitudinal direction (B) of the outlet 53 including an elongated opening shape (FIGS. 3 and 6).

Here, in the blower duct 51 in which the inlet 52 and the outlet 53 are formed in mutually different opening shapes, the portion in which the cross-sectional shape of the passage space 54*a* is changed on the way is present in the passage portion 54 that connects between the inlet 52 and the outlet 53. Incidentally, in the blower duct 51, a bent portion (first bent passage portion 54B) is present in (the passage space 54*a* of) the passage portion 54, whereby the cross-sectional shape of the passage space 54*a* including a substantially square shape, of the introduction passage portion 54A is changed to the cross-sectional shape of the passage space 54*a* including an oblong shape that spreads only in the horizontal direction (irrespective of height) in the first bent passage portion 54B. In other words, the cross-sectional shape of the passage space 54*a* of the introduction passage portion 54A is the cross-sectional shape of the passage space 54*a* that abruptly becomes wide in the first bent passage portion 54B.

Additionally, in the case of the blower duct 51 in which such a portion in which the cross-sectional shape of the passage space 54*a* changes is present, a disturbance, such as flaking or vortex, occurs in the flow of air in the portion in which the cross-sectional shape of the blower duct changes. For this reason, even if air with a uniform wind speed is taken in from the inlet 52, the wind speed of the air that comes out from the outlet 53 tends to become non-uniform. In addition, the tendency for the wind speed of the air that comes out from the outlet in this way to occur substantially similarly even in a case where the direction in which the air in the blower duct 51 is caused to flow (travel) changes irrespective of the presence of a change in the cross-sectional shape of the passage space 54*a*, that is, in a case where the passage space 54*a* becomes a bent shape on the way. In addition, the tendency that the wind speed of the air that comes out from the outlet occurs more strikingly in a case where the cross-sectional shape of the passage space 54*a* changes and the direction in which the air in the blower duct 51 is caused to flow (travel) changes.

Figure 20A:
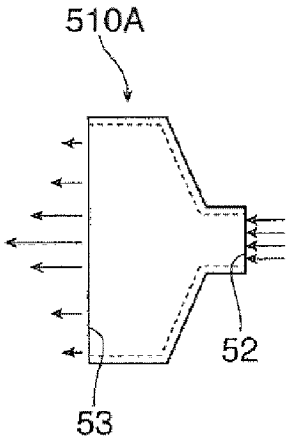
FIGS. 20A to 20D are top explanatory views showing various form examples of the blower duct.
Figure 20B:
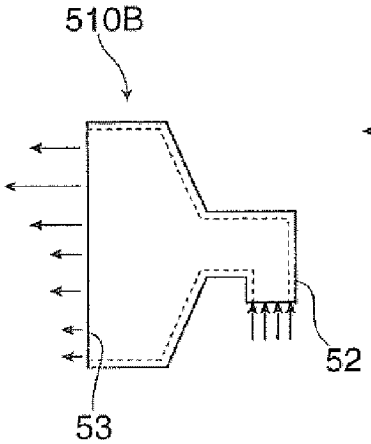
Figure 20C:
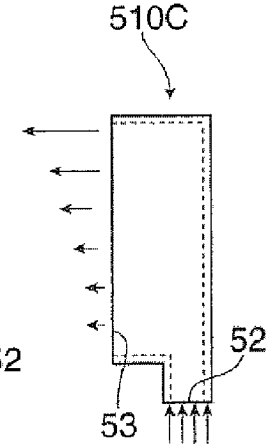
Figure 20D:
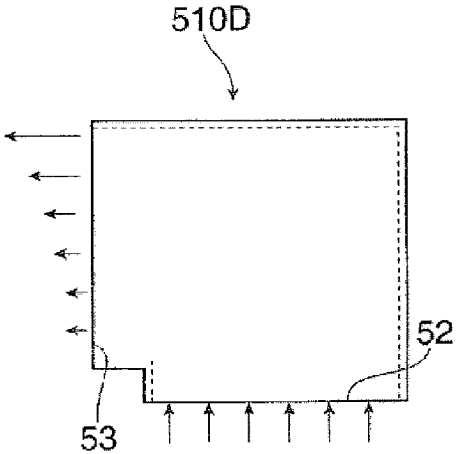

FIGS. 20A to 20D show representative examples 510A to 510C of the blower duct in which the inlet 52 and the outlet 53 are formed in mutually different opening shapes. In the drawings, respective states of the wind speed of air taken into the inlet 52 and the wind speed of air that comes out from the outlet 53 in the respective ducts 510 are shown by the lengths of arrows, respectively. FIGS. 20A to 20D show the respective blower ducts 510 seen from the top face thereof. Additionally, in the drawings, cases where the lengths of the arrows are the same show that the wind speeds are the same, and cases where the lengths of the arrows are different show that the wind speeds are different. Moreover, dotted lines in the drawings show (side wall portions that form) the passage spaces of the respective ducts. Incidentally, the blower ducts 510B and 510C are also configuration examples in which the direction in which air is caused to flow is changed on the way (the passage space 54*a* is bent on the way), and at least one of the cross-sectional shape and cross-sectional area of a passage space is changed. In addition, the blower duct 510D shown in FIG. 20D is a configuration example in which the inlet 52 and the outlet 53 are formed in the same opening shape (and the same opening area), and is a duct in which only the direction in which air is caused to flow is changed on the way.

Thus, the blower duct 51 in the blowing device 5, as shown in FIGS. 3 to 6 or the like, is premised on being a blower duct that includes the passage portion 54 that is formed in a state where the passage space 54*a* for connecting the inlet 52 and the outlet 53 to cause air to flow therethrough is bent at least in one location (two locations in the present example), and that has the inlet 52 formed in a state where the inlet 52 is present outside one end portion 53*a* of the outlet 53 in the longitudinal direction of the outlet 53. In addition to this, two flow control portions 61 and 62 that control the flow of air are provided in different parts in the direction in which the air of the passage space 54*a* of the passage portion 54 is caused to flow. Here, the blower duct 510A of the configuration in which the passage portion is not bent as illustrated in FIG. 20A is not included within the category of the blower duct of the blowing device 5 according to the present Exemplary Embodiment 1.

One flow control portion 61 of the two flow control portions is provided as a "most upstream flow control portion", which cuts off a portion of the first bent passage portion 54B while crossing the portion and makes an elongated gap 63 extending in the crossing direction D present to allow passage of air, in the first bent passage portion 54B equivalent to the bent portion in the passage space 54*a* of the passage portion 54.

The most upstream flow control portion 61 in Exemplary Embodiment 1 is configured by causing a plate-shaped partition member 64 to be arranged within the passage space 54*a* of the bent passage portion 54B so as to cross the passage space with a gap only at the bottom in the cross-sectional shape of the passage space 54*a* without changing the external shape of the first bent passage portion 54B.

Specifically, the partition member 64, as shown in FIG. 4 or the like, cuts off an upper portion of a cross-sectional shape in the passage space 54*a* of the first bent passage portion 54B while crossing the upper portion, and is arranged so that a lower end 64*a* of the partition member has a required interval (height) H with respect to the bottom (inner wall) of the cross-sectional shape of the passage space 54*a*. This forms a structure where the elongated gap 63 extending in the crossing direction is present in a lower portion of the passage space 54*a*. The partition member 64 crosses the passage space 54*a* of the first bent passage portion 54B substantially along a direction substantially orthogonal (a direction substantially parallel to the longitudinal direction B of the charging device 4) to a flow direction R2 of air that is caused to flow through the first bent passage portion 54B.

Additionally, the partition member 64, as shown in FIG. 6 or the like, is provided so that a virtual straight line (two-dot chain line) VL that passes through both end portions 63*a* and 63*b* of the gap 63 in the crossing direction D is present further toward the downstream side in the flow direction R2 of air that is caused to flow through the first bent passage portion 54B than an inner end portion 52*a* located near the first bent passage portion 54B equivalent to the bent passage space portion of the inlet 52.

Specifically, the passage portion 54 of the blower duct 51 has a shape in which a bent angular portion 54K that becomes a boundary portion between the first bent passage portion 54B equivalent to the bent passage space portion and the introduction passage portion 54A equivalent to the passage space portion immediately before the bent passage space portion is present from the inner end portion 52*a* of the inlet 52 to an end portion 61*a* (one end portion 64*a* of the partition member) of (the partition member 64 that constitutes of) the most upstream flow control portion 61 near the inlet 52. The bent angular portion 54K has, for example, a shape that is bent substantially at a right angle. The partition member 64 is arranged so that a most upstream end thereof is present at a position shifted by a required distance N from the bent angular portion 54K to the downstream side in the flow direction R2 of air in the first bent passage portion 54B (FIG. 4). Incidentally, the bent angular portion 54K may be formed in the shape of a curved surface from the viewpoints of reducing the presence of a region bent substantially at a right angle to promote the flaking phenomenon of air to be described below or of enhancing the inducing effect of air to the introduction passage portion 54A in a flowing direction (a curved side wall surface 54R as shown by dotted lines in FIG. 6 or 12). That is, a portion (side surface portion) between the inner end portion 52*a* of the inlet 52 and the end 61*a* of the most upstream flow control portion 61 near the inlet 52 is formed by the curved side wall surface 54R. The curved side wall surface 54R may be constituted by a curved surface having a required curvature, and may also be constituted by a polygonal face including plural, specifically, three or more faces.

The installation position (the distance N shifted to the downstream side in the flow direction R2 of air) of the partition member 64 that constitutes the most upstream flow control portion 61, the height H of the gap 63, the path length M and path width (the length in the longitudinal direction) W are selected and set from the viewpoint of making the wind speed of the air that has flowed into the first bent passage portion 54B from the introduction passage portion 54A as uniform as possible. Additionally, these values are set in consideration of the dimensions (capacity) of the duct 51, and the flow rate per unit time of air that is caused to flow to the duct 51, the charging device 4, or the like.

For example, the lower limit of the distance N equivalent to the installation position of the partition member 64 is preferably at least equal to or more than 5 mm. On the other hand, the upper limit of this distance N, for example, is set within a range where the effect of making the wind speed uniform by the most upstream flow control portion 61 may be obtained. Additionally, the height H of the gap 63 may be set to the dimension uniformly or partially changed from the above viewpoint or the like without being limited to a case where the dimension is the same in the width direction. Such a partition member 64 is formed by being molded integrally with the same material as the duct 51 or is formed from a material separate from the duct 51.

Figure 7:
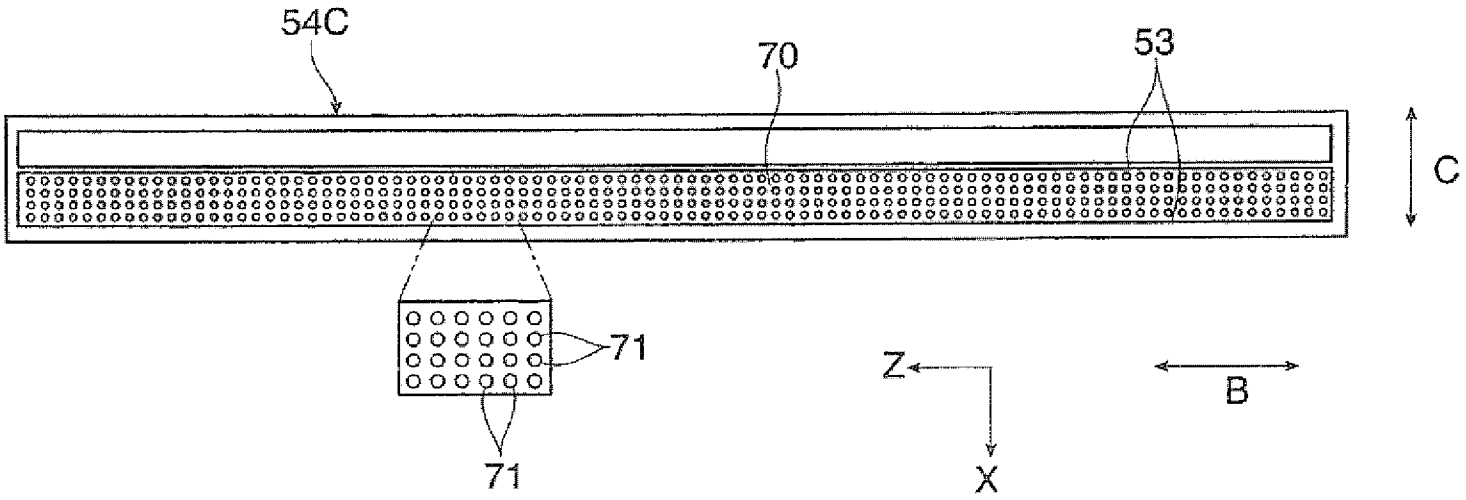
FIG. 7 is a view showing a state when the blowing device of FIG. 3 is seen from below (outlet)

Additionally, one flow control portion 62 out of the two flow control portions, as shown in FIG. 4 or 7, is provided as a "most downstream flow control portion" that is brought into a state where the outlet 53 that is an opening of a terminating end in the passage space 54*a* of the second bent passage portion 54C is closed by a permeable member 70 dotted with plural ventilation portions 71.

All the plural ventilation portions 71, as shown in FIG. 7, are through holes that extend so that each opening shape is substantially circular and penetrate in the shape of a straight line. Additionally, the plural ventilation portions 71, for example, are arranged at regular intervals along the longitudinal direction (B) of the opening shape of the outlet 53, and are arranged so as to be present in four rows at the same intervals as the above regular intervals even in the lateral direction C orthogonal to the longitudinal direction. Thereby, the plural air holes 71 are formed so as to be dotted throughout the passage space of the terminating end of the second bent passage portion 54C, or the opening shape of the outlet 53. For this reason, the permeable member 70 in Exemplary Embodiment 1 is a perforated plate formed so that the plural ventilation portions (holes) 71 are dotted in a plate-shaped member. Moreover, it is preferable that the plural ventilation portions 71 be formed so as to be dotted substantially uniformly (in a substantially constant density) in the opening region of the outlet 53. However, unless the air non-uniformly comes out from the outlet 53, the ventilation portions may be formed so as to be present in a slightly dense state.

The permeable member 70 may be formed by being molded integrally with the same material as the duct 51 or may be formed from a material separate from the duct 51. The opening shape, opening dimensions, hole length, and hole presence density of the ventilation portions (holes) 71 are selected and set from the viewpoint of making the wind speed of air that has flowed out of the second bent passage portion 54C through the outlet 53 as uniform as possible. Additionally, these values are set in consideration of the dimensions (capacity) of the duct 51, the flow rate per unit time of air that is caused to flow to the duct 51, the charging device 4, or the like.

The operation of the blowing device 5 will be described below.

If the blowing device 5 arrives at driving setting timing, such as image forming operation timing, the blower 50 is first rotationally driven to send out a required volume of air. The air (E) sent from the started blower 50, as shown in FIG. 5, is taken into the passage space 54*a* of the passage portion 54 through the connection duct 55 from the inlet 52 of the blower duct 51.

Figure 5:
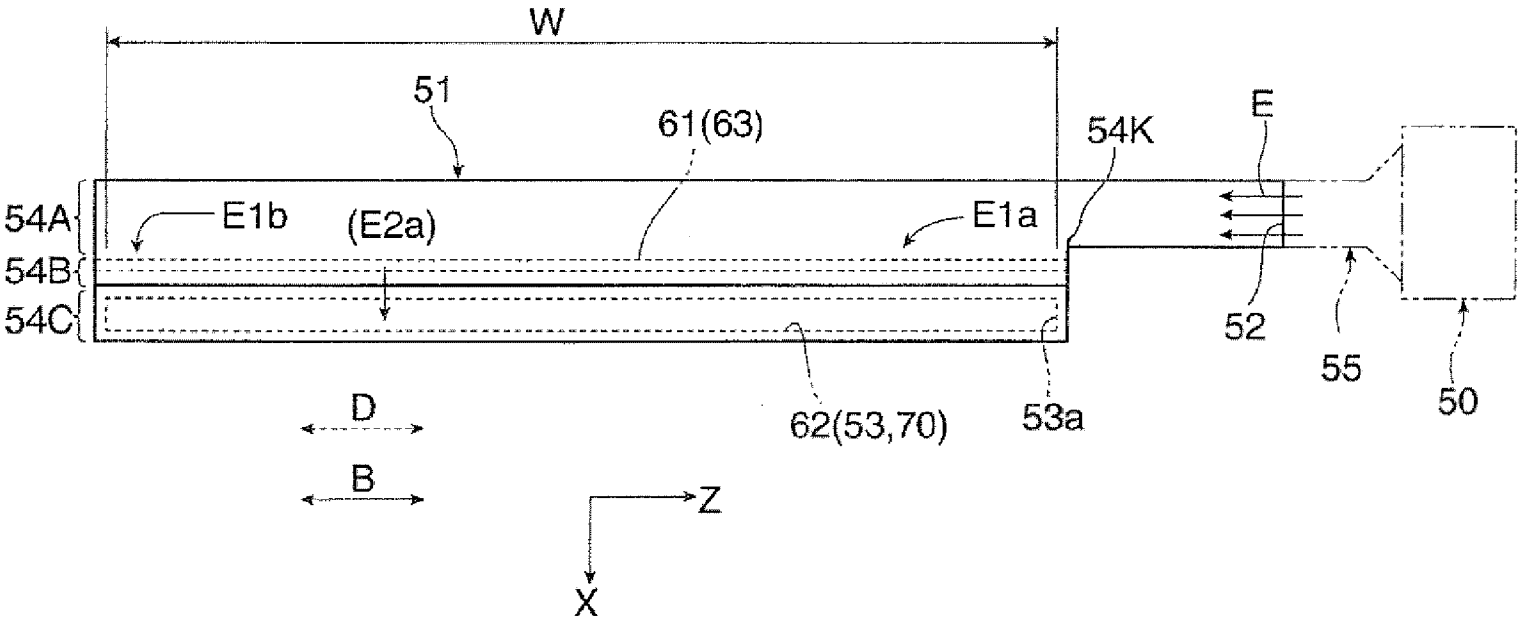
FIG. 5 is a schematic view showing a state when the blowing device of FIG. 3 is seen from above.

Subsequently, the air (E) taken into the blower duct 51, as shown in FIG. 5, is sent so as to flow into the passage space 54*a* of the first bent passage portion 543 through the passage space 54*a* of the introduction passage portion 54A (refer to arrows E1*a*, E1*b*, or the like of FIG. 5). The air (E1) sent into the first bent passage portion 54B passes through a gap 63 of the upstream flow control portion 61, is brought into a state where the traveling direction (direction in which air flows) thereof is changed to an substantially right-angled direction (refer to the direction of arrow E2*a* of FIG. 5), and is sent so as to flow into the passage space 54*a* of the first bent passage portion 54B (refer to the direction of arrow E2*a*, E2*b*, or the like of FIG. 8).

In this case, the air (E2) when passing through the gap 63 of the most upstream flow control portion 61 and flowing into the passage space 54*a* of the first bent passage portion 54B has its flow controlled by the most upstream flow control portion 61 (the pressure of the air is brought into a raised state), and flows out of the gap 63 in a uniform state. Moreover, as for the air (E2) when flowing into the passage space 54*a* of the first bent passage portion 54B, the direction of the air when flowing out of the gap 63 of the flow control portion 61 is aligned with a direction substantially orthogonal to the longitudinal direction (B) of the outlet 53.

Subsequently, the air (E2) that has flowed into the passage space 54*a* of the first bent passage portion 54B moves to the passage space 54*a* of the second bent passage portion 54C that is continuous in the state of being bent in a substantially orthogonal direction downward from the first bent passage portion 54B. The air (E2) that has flowed into the passage space 54*a* of the second bent passage portion 54C flows into the passage space 54*a* of the second bent passage portion 54C whose volume is larger than the passage space 54*a* of the introduction passage portion 54A or the space of the gap 63, and is thereby stagnated within the passage space 54*a* of the second bent passage portion 54C, and the unevenness of the wind speed is reduced.

Figure 8:
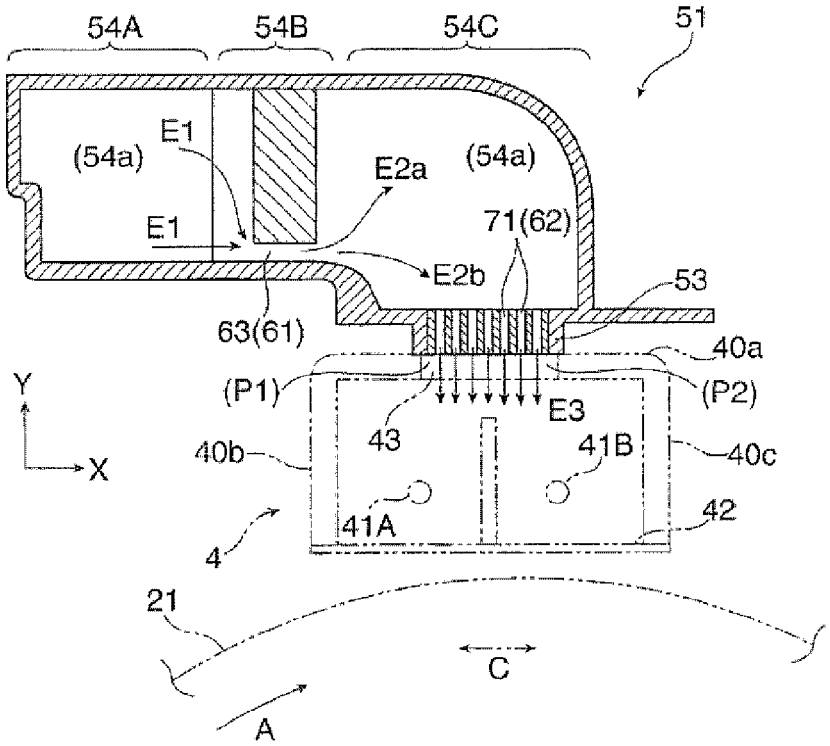
FIG. 8 is an explanatory view showing the state or the like of an operation of the blowing device of FIG. 3.

Finally, the air (E2) that has flowed into and stagnated in the second bent passage portion 540, as shown in FIG. 8, passes through the plural ventilation portions (holes) 71 in the permeable member 70 that constitutes the most downstream flow control portion 62 provided at the termination end or the outlet 53 of the bent passage portion 540, and is thereby blown out from the outlet 53 in a state where the traveling direction thereof is changed (refer to the direction, length, or the like of the arrow E3 of FIG. 8).

In this case, the air (E3) blown out from the outlet 53 passes through the plural ventilation portions 71 in the permeable member 70 that is relatively narrower than the opening area of the outlet 53, and is thereby sent out in a state where the flow thereof is controlled (at this time, the pressure of the air is brought into a raised state). Finally, the air (E3) that is blown out from the outlet 53 passes through the plural ventilation portions 71 that are dotted over the whole opening region of the outlet 53 and formed on the same conditions, whereby the air is sent out from the outlet 53 in a uniform state so as to be equivalent to the surface of a region substantially similar to the opening shape of the outlet 53. Moreover, the air (E3) blown out from the outlet 53 has its traveling direction changed to the direction substantially orthogonal to the longitudinal direction of the outlet 53, and is sent out.

From the above, the air (E3) that comes out of the plural ventilation portions 71, respectively, of the permeable member 70 in the most downstream flow control portion 62 is sent out in a state where the traveling direction thereof becomes the direction substantially orthogonal to the longitudinal direction of the outlet 53, and the wind speed thereof is brought into a substantially uniform state. Additionally, the wind speed of the air (E3) that comes out from the outlet 53 is brought into a substantially uniform state in the longitudinal direction (B) of the opening shape (oblong shape) of the outlet 53, and is brought into a substantially uniform state also in the lateral direction C (FIG. 4, FIG. 7, or the like) substantially orthogonal to the longitudinal direction (B).

Moreover, the aforementioned arrangement of the most upstream flow control portion 61 reduces relative weakening of the wind speed of the air that is finally discharged from the outlet 53 at the end portion 53*a* of the outlet 53 near the inlet 52 in the longitudinal direction (B) of the outlet 53. Thereby, the air discharged from the outlet 53 is discharged in a state where the unevenness of the wind speed in the whole region in the longitudinal direction of the outlet 53 is further reduced.

Then, the air (E3) sent out from the outlet 53 of the blower duct 51, as shown in FIG. 8, is blown into the case 40 through the opening 43 formed in the top face 40*a* of the shielding case 40 of the charging device 4, and is blown against the grid electrode 42 attached so as to be present in the two corona discharge wires 41A and 41B arranged within a space divided with a partition wall 40*d* present at the inner center of the case 40 as a boundary, and the lower opening of the case 40.

At this time, since the air blown against the corona discharge wires 41A and 41B and the grid electrode 42 comes out from the outlet 53 at a substantially uniform wind speed in both the directions of the longitudinal direction (B) and the lateral direction C of the outlet 53 of the blower duct 51, the air is also blown against the two discharge wires 41A and 41B and the grid electrode 42 in a substantially equal state. Additionally, since the blown air is discharged from the outlet 53 in a state where relative weakening of the wind speed at the end portion 53*a* of the outlet 53 of the blower duct 51 near the inlet 52 in the longitudinal direction (B) is reduced, air is also blown against the regions of the two discharge wires 41A and 41B and the grid electrode 42 that face the end portion 53*a* of the outlet at a substantially same wind speed as the other regions.

Thereby, unnecessary substances, such as paper debris, an additive agent of toner, and a discharge product, which are going to adhere to the two discharge wires 41A and 41B and the grid electrode 42, respectively, may be kept away from the discharge wires or the grid electrode. As a result, degradation, such as unevenness, may be prevented from occurring in charging performance owing to sparse adhesion of unnecessary substances to the discharge wires 41A and 41B or the grid electrode 42 in the charging device 4, and the peripheral surface of the photoconductor drum 21 may be more uniformly (uniformly in both directions of the axial direction and the circumferential direction along the rotational direction A) charged. Additionally, a toner image formed in the image forming unit 20 including the charging device 4, and an image finally formed on a sheet 9 are obtained as excellent images in which occurrence of image defects (uneven density or the like) resulting from charging defects, such as uneven charging, is reduced.

Test

Next, an evaluation test regarding the performance characteristic (wind speed distribution at the outlet 53 of the blower duct 51) performed using the blowing device 5 will be described.

The test is performed by introducing the air with an air volume where the mean wind speed from the outlet 53 of the blower duct 51 becomes about 1.0 m/sec, from the blower 50 and measuring the wind speed in the longitudinal direction (B) of the outlet 53 at that time. The measurement is performed by using an air speedometer (F900 made by Cambridge AccuSense, Inc), and as shown in FIG. 8, moving the air speedometer in the longitudinal direction B in two locations including an end position P1 (pre-position) located on the upstream side of the outlet 53 in the rotational direction A of the photoconductor drum 21 and an end position P2 (post-position) located on the downstream side in the rotational direction A. The results of this test are shown in FIG. 9.

As the blower duct 51, a blower duct in which the overall shape is shown in FIG. 3 to FIG. 7, the inlet 52 has a substantially square opening shape of 22 mm×23 mm, and the outlet 53 has an oblong opening shape of 17.5 mm×350 mm is used. Additionally, the most upstream flow control portion 61 is configured so that, in a region located at a position shifted by the dimension of N=6 mm from the bent angular portion 54K in the first bent passage portion 54B to the downstream side in the flow direction R2 of air, the height H of the gap 63 is a dimension that inclines within a range of 1 to 2 mm, the path length M becomes 8 mm, and the width W becomes 345 mm. Moreover, the most downstream flow control portion 62 is configured using the porous member 70 in which the ventilation holes 71 with a hole diameter of 1 mm and a length of 3 mm are provided on the condition that the density of the holes becomes 0.42 holes/$mm^2$ (≈42 holes/$cm^2$).

Figure 9:
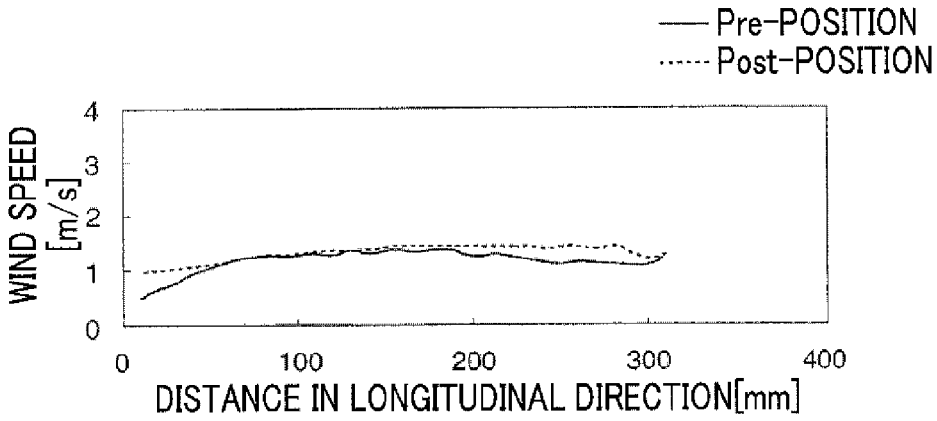
FIG. 9 is a graph chart showing the results of an evaluation test when a wind-speed state at an outlet of the blower duct in the blowing device according to Exemplary Embodiment 1 is measured.

The wind speed in the longitudinal direction (B) of the outlet 53 of this blower duct 51, as shown in FIG. 9, becomes a value near about 1.0 m/sec that is the mean wind speed of a target value substantially over the whole region in the longitudinal direction. Additionally, it turns out that the results of the respective wind speeds at the pre-position P1 and the post-position P2 of the outlet 53 are the almost same value in the longitudinal direction (B) of the outlet 53, and thereby the wind speeds in the lateral direction C of the outlet 53 are also brought into a uniform state.

Analysis

Next, the analysis based on the computer simulation performed using the blower duct 51 of the blowing device 5 will be described.

Figure 10:
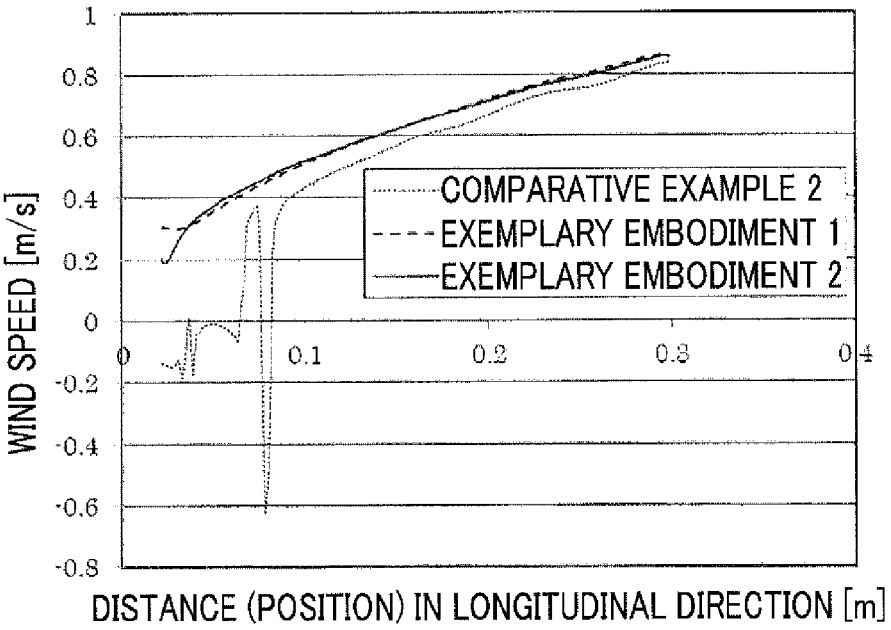
FIG. 10 is a graph chart showing the results when a wind-speed state of a −Y-direction component at the outlet of the blower duct (the blower ducts of Exemplary Embodiment 2 and Comparative Example 2) according to Exemplary Embodiment 1 is simulated.

The wind speed distribution of a component (a −Y direction component) that blows out downward (a direction −Y opposite to the direction of the coordinate axis Y) out of the air (E3) that blows out from the outlet 53 of the blower duct 51 is investigated by performing a computer simulation on the basis of the blower duct 51 used in the test. The results (Exemplary Embodiment 1) are shown in FIG. 10.

Figure 11:
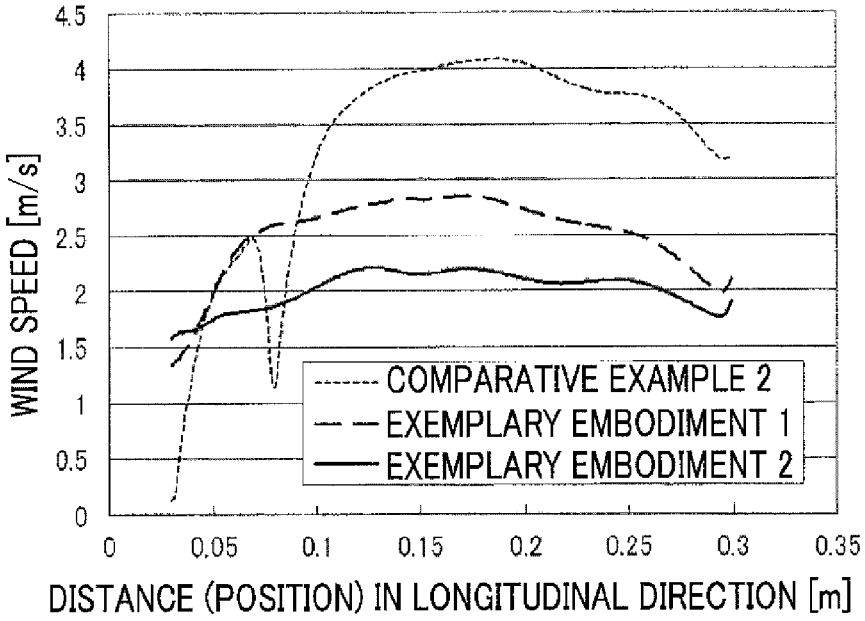
FIG. 11 is a graph chart showing the results when a wind-speed state of the air discharged in all the directions from the outlet of the blower duct (the blower ducts of Exemplary Embodiment 2 and Comparative Example 2) according to Exemplary Embodiment 1 is simulated.

Additionally, all the wind speed distributions of the air (E3) that blows out in various directions from the outlet 53 of the blower duct 51 in this computer simulation are also investigated. That is, the wind speed at this time becomes the result when the component that blows out downward from the outlet 53 and all components that blow out in the other various directions are totaled. The results (Exemplary Embodiment 1) are shown in FIG. 11.

From the results shown in FIG. 10, as for the wind speed in the longitudinal direction (B) of the outlet 53 of the blower duct 51, relative weakening of the wind speed at the end portion 53*a* (a position where the distance in the longitudinal direction shown in this drawing becomes about 0 to 0.08 m) of the outlet 53 near the inlet 52 is sharply reduced (refer to the results of Comparative Example 2 to be described below and the data of FIG. 10 for comparison). Thereby, as shown by the results of FIG. 11, it turns out that air is discharged in a state where the unevenness of the wind speed in the whole region in the longitudinal direction (B) of the outlet 53 is also reduced (refer to the data of Comparative Example 2 of FIG. 11 for comparison). Incidentally, it is confirmed that the effect relating to such wind speed is more reliably obtained in a case where the bent angular portion 54K is formed by the curved side wall surface 54R (refer to FIG. 6 or the like) as described above.

Figure 12:
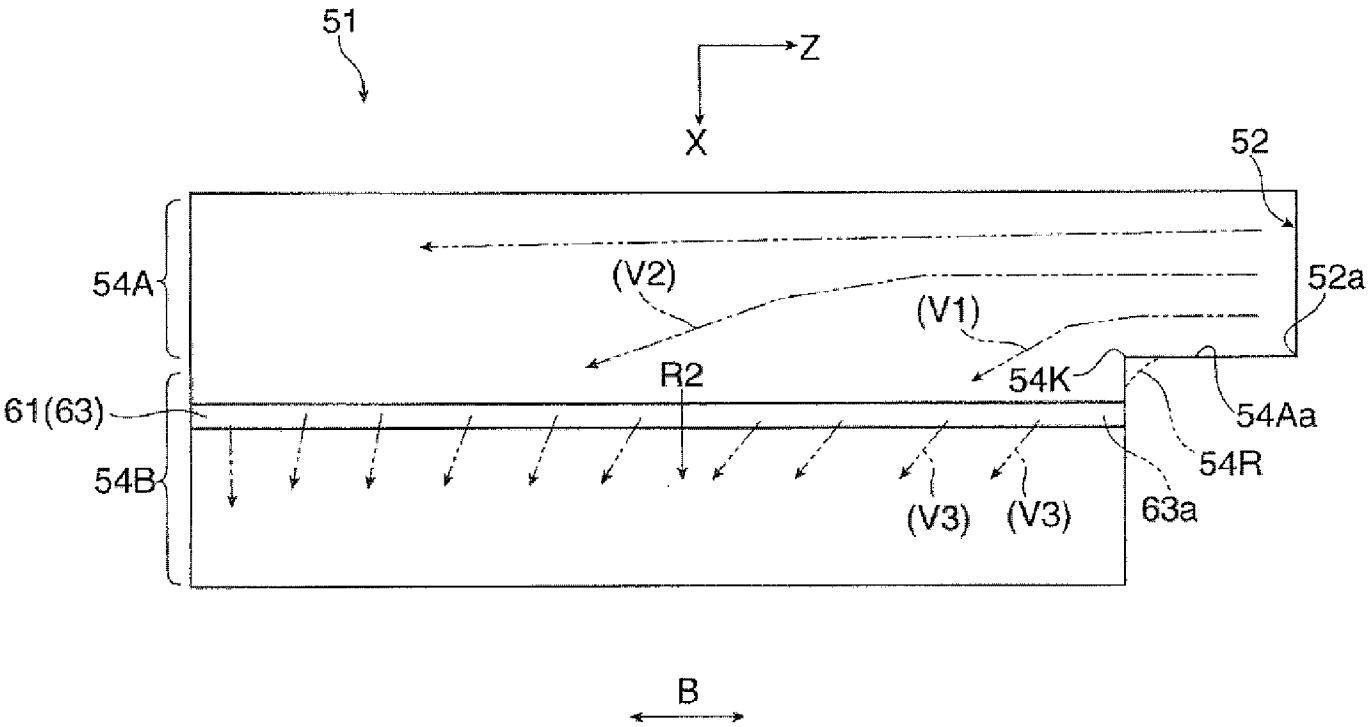
FIG. 12 is an explanatory view schematically showing an air flow direction and an air flow state in the blower duct according to Exemplary Embodiment 1.

As schematically illustrated in FIG. 12, it may be inferred that this is caused by a factor that the partition member 64 that constitutes the most upstream flow control portion 61 is arranged in a state where the partition member is present on the downstream side of the first bent passage portion 54B in the flow direction R2 of air as mentioned above, and thereby, the bent angular portion 54K that becomes a boundary portion between the introduction passage portion 54A and the first bent passage portion 54B is present (remains).

That is, the air taken in from the inlet 52 travels in a state where the flaking phenomenon of a flow occurs from a side wall surface 54Aa of the introduction passage portion 54A connected with the angular portion 52K in the bent angular portion 54K and the flow is slightly bent in a direction following the first bent passage portion 54B, as shown by the two-dot chain lines V1 and V2 with an arrow in FIG. 12, in the process of flowing through the introduction passage portion 54A so as to travel along the direction of the coordinate axis Z (almost the same direction as the longitudinal direction B of the outlet 53). Thereby, as for the air when entering the elongated gap 63 in the most upstream flow control portion 61 so as to pass through the gap, a component (straight-ahead component) that tries to go straight in the direction of the coordinate axis Z in the introduction passage portion 54A is weakened, and the flowing direction of the air is changed so as to run along the original flow direction R2 of air in the first bent passage portion 54B. As a result, it is considered this is because the air that passes through the gap 63 in the most upstream flow control portion 61 passes through a portion near the end portion 63*a* of the gap 63 near the inlet 52 more (refer to two-dot chain lines V3 with an arrow), and finally relative weakening of the wind speed at the end portion 53*a* of the outlet 53 near the inlet 52 is reduced.

COMPARATIVE EXAMPLE 1

Figure 21:
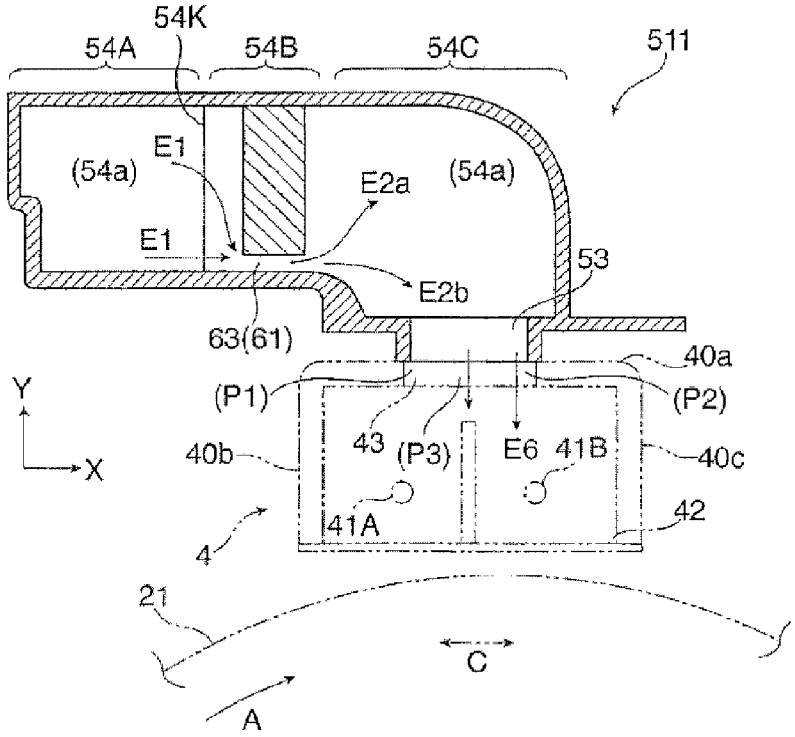
FIG. 21 is a cross-sectional view showing a blowing device (blower duct) of Comparative Example 1.

FIG. 21 shows a blower duct 511 as Comparative Example 1 taken for reference.

The blower duct 511 of Comparative Example 1 is different from the blower duct 51 (refer to FIG. 4) of the blowing device 5 according to Exemplary Embodiment 1 only in that a change is made so that the outlet 53 is not provided with the permeable member 70 having the plural ventilation portions 71. That is, the blower duct 510, as shown in FIG. 21, has the outlet 53 formed as an opening including an oblong opening shape. Reference numeral E6 of FIG. 21 schematically shows the state of air that comes out from the outlet 53.

Figure 22:
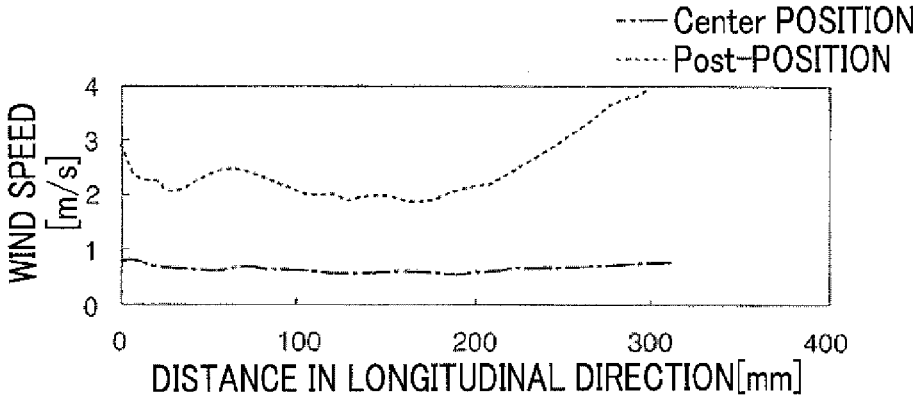
FIG. 22 is a graph chart showing the results of an evaluation test when a wind-speed state at an outlet of the blower duct of Comparative Example 1 is measured.

FIG. 22 shows the results of an evaluation test in which the performance characteristic (wind speed distribution at the outlet 53) of the blower duct 511 in the blowing device of this Comparative Example 1 is investigated. Although different in the following points, the test is performed similarly to the case of the test in Exemplary Embodiment 1 in points other than these points. That is, in the blower duct 511 of Comparative Example 1, the wind speed at the pre-position P1 of the outlet 53 is almost zero. Therefore, the measurement of the wind speed, as shown in FIG. 21, is performed in two locations including a center position P3 that becomes a middle point between the pre-position P1 and the post-position P2 of the outlet 53 in the rotational direction A of the photoconductor drum 21, and the post-position P2.

As is clear from the results of FIG. 22, in the blower duct 511 of Comparative Example 1, it turns out that the wind speed in the longitudinal direction (B), particularly, at the post-position P2 of the outlet 53 is brought into a sharply different state, and the wind speed in the lateral direction C of the outlet 53 is also brought into a non-uniform state. At the pre-position P1 of the outlet 53, it becomes evident that the wind speed is almost zero as mentioned above, and air hardly comes out.

COMPARATIVE EXAMPLE 2

Figure 23:
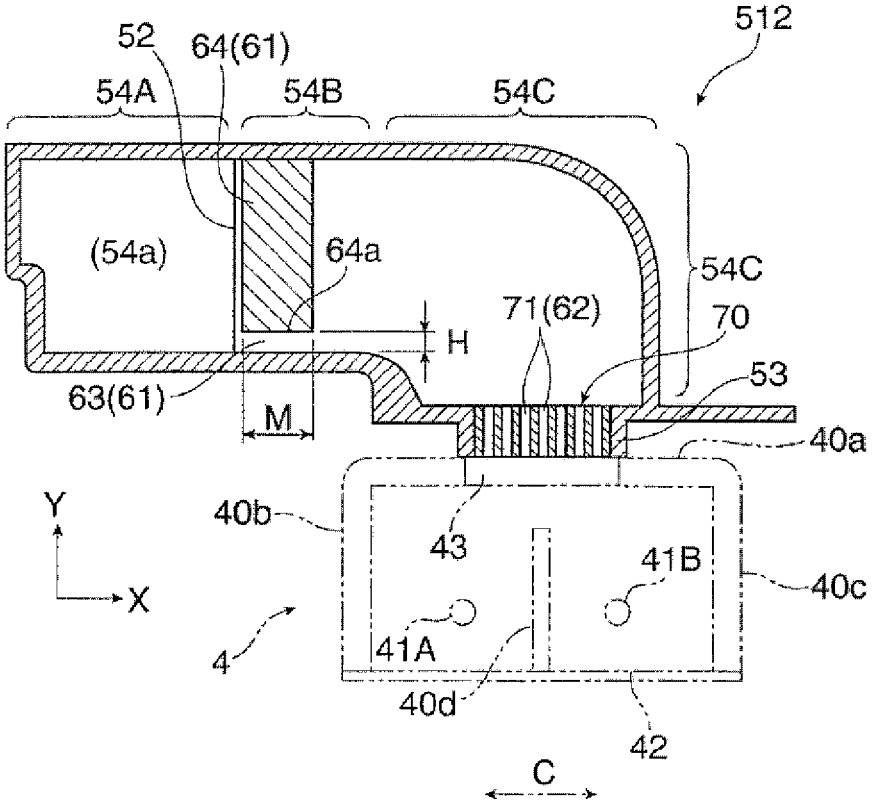
FIG. 23 is a cross-sectional view showing a blowing device (blower duct) of Comparative Example 2.

FIG. 23 shows a blower duct 512 as Comparative Example 2 taken for reference.

The blower duct 512 of Comparative Example 2 is different from the blower duct 51 (refer to FIG. 4) of the blowing device according to Exemplary Embodiment 1 only in that the installation position of the partition member 64 that constitutes the most upstream flow control portion 61 is changed. That is, in the blower duct 512, as shown in FIG. 23, the partition member 64 is arranged in a state where the same position as the bent angular portion 54K (FIG. 24) is almost adopted as a starting point, without being shifted from the bent angular portion 54K to the downstream side in the flow direction R2 of air in the first bent passage portion 54B (FIG. 24).

Next, analysis based on computer simulation is performed similarly to the case of the analysis in Exemplary Embodiment 1 using the blower duct 512 of this Comparative Example 2. First, the wind speed distribution of a component (−Y direction component) that blows out downward out of the air that blows out from the outlet 53 of the blower duct 512 is investigated. The results (Comparative Example 2) are shown together in FIG. 10. Additionally, all the wind speed distributions of the air that blows out in various directions from the outlet 53 of the blower duct 512 are investigated. The results (Comparative Example 2) are shown together in FIG. 11.

As is clear from the results of FIG. 10, in the blower duct 512 of Comparative Example 2, the wind speed in the longitudinal direction (B) of the outlet 53 is sharply reduced because the wind speed at the end portion 53*a* (a position where the distance in the longitudinal direction shown in this drawing becomes about 0 to 0.08 m) of the outlet 53 near the inlet 52 is relatively weakened compared to other parts or air blows out only in directions different from the downward direction of the outlet 53. Additionally, thereby, as shown by the results of FIG. 11, it turns out that the unevenness of the wind speed in a region including the end portion 53*a* of the outlet 53 near the inlet 52 in the longitudinal direction (B) of the outlet occurs, and the unevenness of the wind speed in the longitudinal direction of the outlet 53 occurs.

Figure 24:
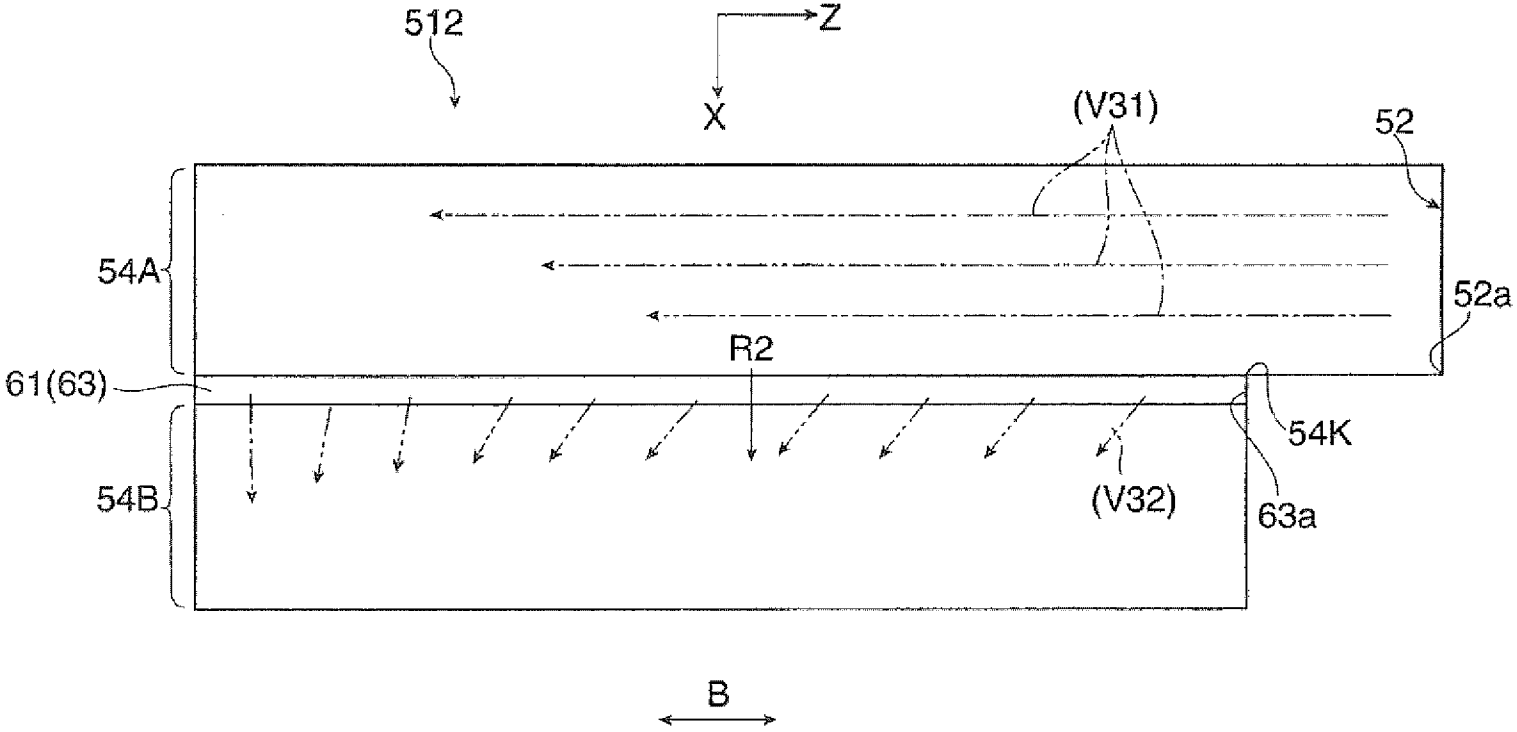
FIG. 24 is an explanatory view schematically showing an air flow direction and an air flow state in the blower duct of Comparative Example 2.

As schematically illustrated in FIG. 24, it may be inferred that this is caused by a main factor that the partition member 64 that constitutes the most upstream flow control portion 61 is arranged in a state where almost the same position as the passage angular portion 54K (FIG. 24) is adopted as a starting point, without being shifted from the bent passage angular portion 54K to the downstream side in the flow direction R2 of air in the first bent passage portion 543 as mentioned above, and thereby, the bent angular portion 54K that becomes a boundary portion between the introduction passage portion 54A and the first bent passage portion 54B is not present.

That is, the air taken in from the inlet 52 travels with only a substantially straight-ahead component that tries to go straight in the direction of the coordinate axis Z in the introduction passage portion 54A, as shown by two-dot chain lines V31 with an arrow in FIG. 24, in the process of flowing through the introduction passage portion 54A so as to travel along the direction of the coordinate axis Z (almost the same direction as the longitudinal direction B of the outlet 53). Thereby, as for the air when entering the elongated gap 63 in the most upstream flow control portion 61 so as to pass through the gap, the straight-ahead component that tries to go straight in the direction of the coordinate axis Z in the introduction passage portion 54A without being almost weakened, and the direction of the air that flows so as to run along the original flow direction R2 of air in the first bent passage portion 54B is hardly changed. That is, in the blower duct 512, the angular portion 54K that is bent as in the blower duct 51 according to Exemplary Embodiment 1 is not present. Thereby, the flaking phenomenon (FIG. 12) of a flow does not occur from the side wall surface 54Aa as described above in the bent angular portion 54K. As a result, as for the air that passes through the gap 63 in the most upstream flow control portion 61, the proportion of the air that passes through a portion near the end portion 63*a* of the gap 63 near the inlet 52 decreases (refer to two-dot chain lines V32 with an arrow). For this reason, it is considered that the wind speed at the end portion 53*a* of the outlet 53 near the inlet 52 is relatively weakened compared to other regions.

Exemplary Embodiment 2

Figure 13:
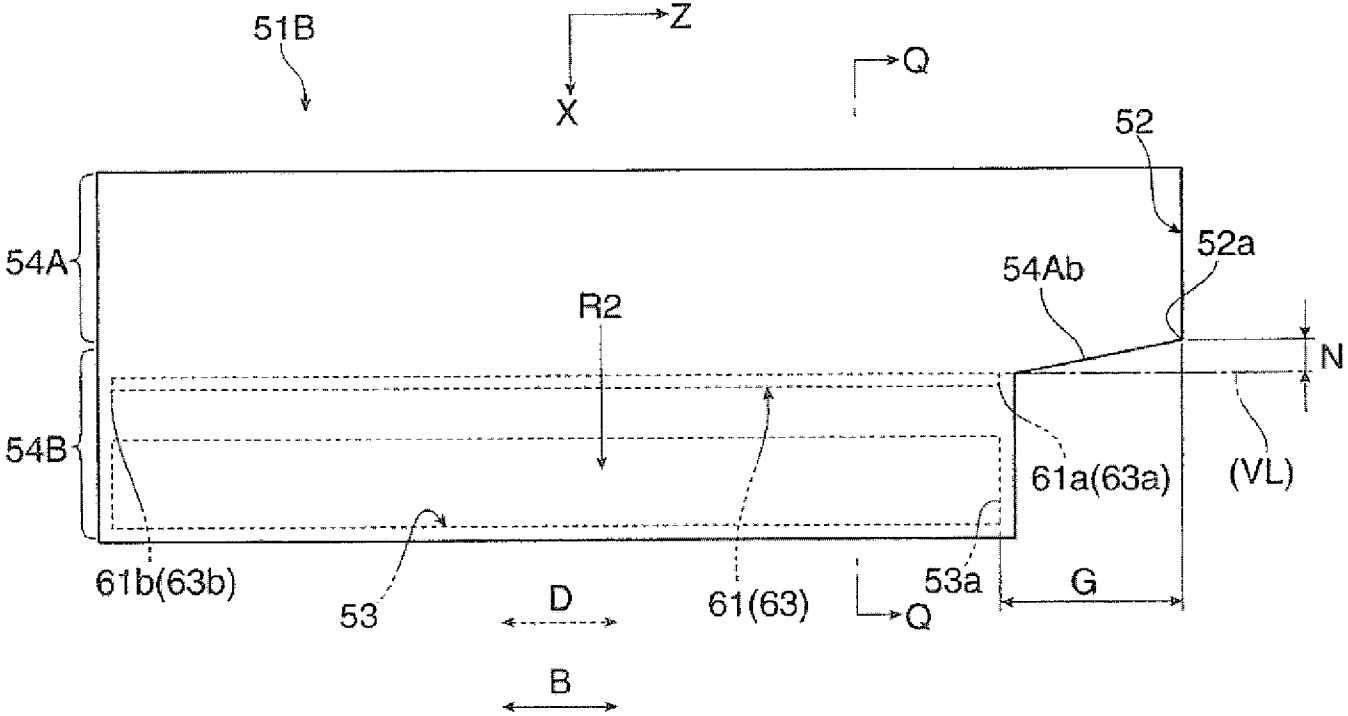
FIG. 13 is an explanatory view showing a blowing device (blower duct) according to Exemplary Embodiment 2.
Figure 14:
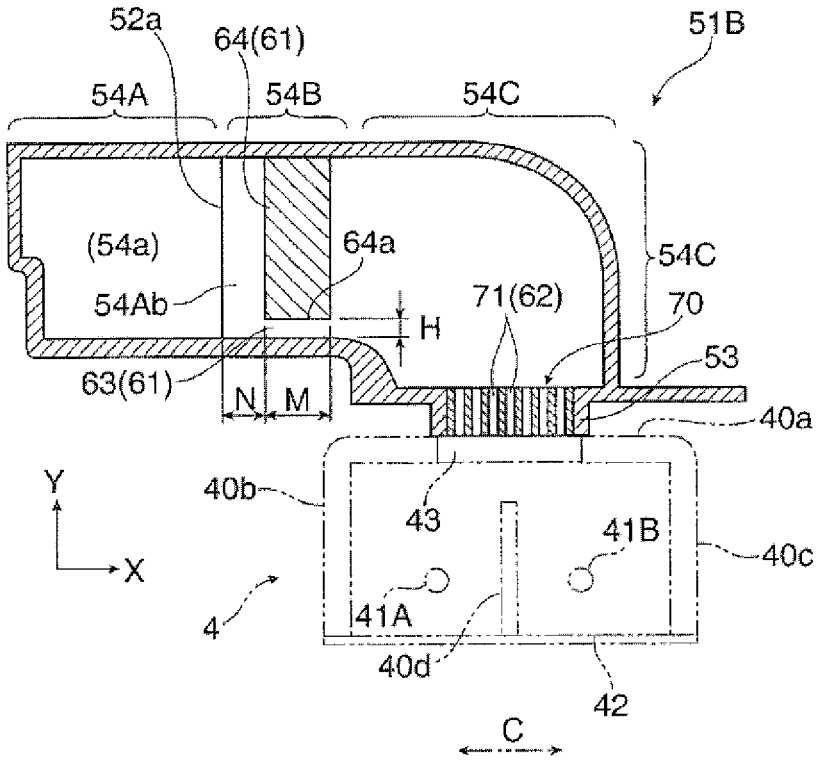
FIG. 14 is a cross-sectional view along line Q-Q of the blowing device (blower duct) of FIG. 13.

FIGS. 13 and 14 show a blowing device according to Exemplary Embodiment 2, and show a blower duct 513 in the blowing device (5B).

The blowing device (5B) has the same configuration as the blowing device 5 according to Exemplary Embodiment 1 except that a change is made so that the blower duct 51B with a partially different configuration is used. The blower duct 51B, as shown in FIG. 13 or the like, has the same configuration as the blower duct 51 according to Exemplary Embodiment 1 except that a side surface portion from the inner end portion 52*a* of the inlet 52 located near the first bent passage portion 54B to the end portion 61*a* of the most upstream flow control portion 61 near the inlet 52 is formed in a shape that is connected in the shape of a straight line. In the subsequent drawings, common constituent elements are designated by the same reference numerals, and the description of the constituent elements is omitted except when necessary (this is the same also in the exemplary embodiments hereafter).

That is, in the blower duct 51B, the side surface portion from the inner end portion 52*a* of the inlet 52 to the end portion 61*a* of the most upstream flow control portion 61 near the inlet 52 is formed by a side wall surface 54Ab including one plane. Thereby, in this blower duct 513, the bent angular portion 54K (refer to FIG. 6 or the like) that becomes a boundary portion between the introduction passage portion 54A and the first bent passage portion 54B in the blower duct 51 according to Exemplary Embodiment 1 is not present. As a result, the inner end portion 52*a* of the inlet 52 and the end portion 61*a* of the flow control portion 61 near the inlet 52 are connected straight.

Analysis

Next, analysis based on computer simulation is performed similarly to the case of Exemplary Embodiment 1 using the blower duct 51B.

That is, the wind speed distribution of a component (−Y-direction component) that blows out downward out of the air that blows out from the outlet 53 of the blower duct 51B is investigated, and the results (Exemplary Embodiment 2) are together shown in FIG. 10. Additionally, all the wind speed distributions of the air that blows out in various directions from the outlet 53 of the blower duct 51B are investigated, and the results (Exemplary Embodiment 2) are together shown in FIG. 11.

From the results shown in FIG. 10, as for the wind speed in the longitudinal direction (B) of the outlet 53 of the blower duct 51B, relative weakening of the wind speed at the end portion 53*a* (a position where the distance in the longitudinal direction shown in this drawing becomes about 0 to 0.08 m) of the outlet 53 near the inlet 52 is sharply reduced (refer to the results of Comparative Example 2 and the data of FIG. 10 for comparison). Thereby, as shown by the results of FIG. 11, it turns out that air is discharged in a state where the unevenness of the wind speed in the whole region in the longitudinal direction (B) of the outlet 53 is also sharply reduced (refer to the data of Comparative Example 2 of FIG. 11 for comparison). It turns out that the unevenness of the wind speed in the whole region in the longitudinal direction (B) of the outlet 53 in the blower duct 51B is sharply reduced more than the case of the blower duct 51 according to Exemplary Embodiment 1, and air is discharged in a state where the air discharged from the outlet 53 is brought into an almost uniform state in the whole region in the longitudinal direction (B) of the outlet (refer to the data of Exemplary Embodiment 1 of FIG. 11 for comparison).

Figure 15:
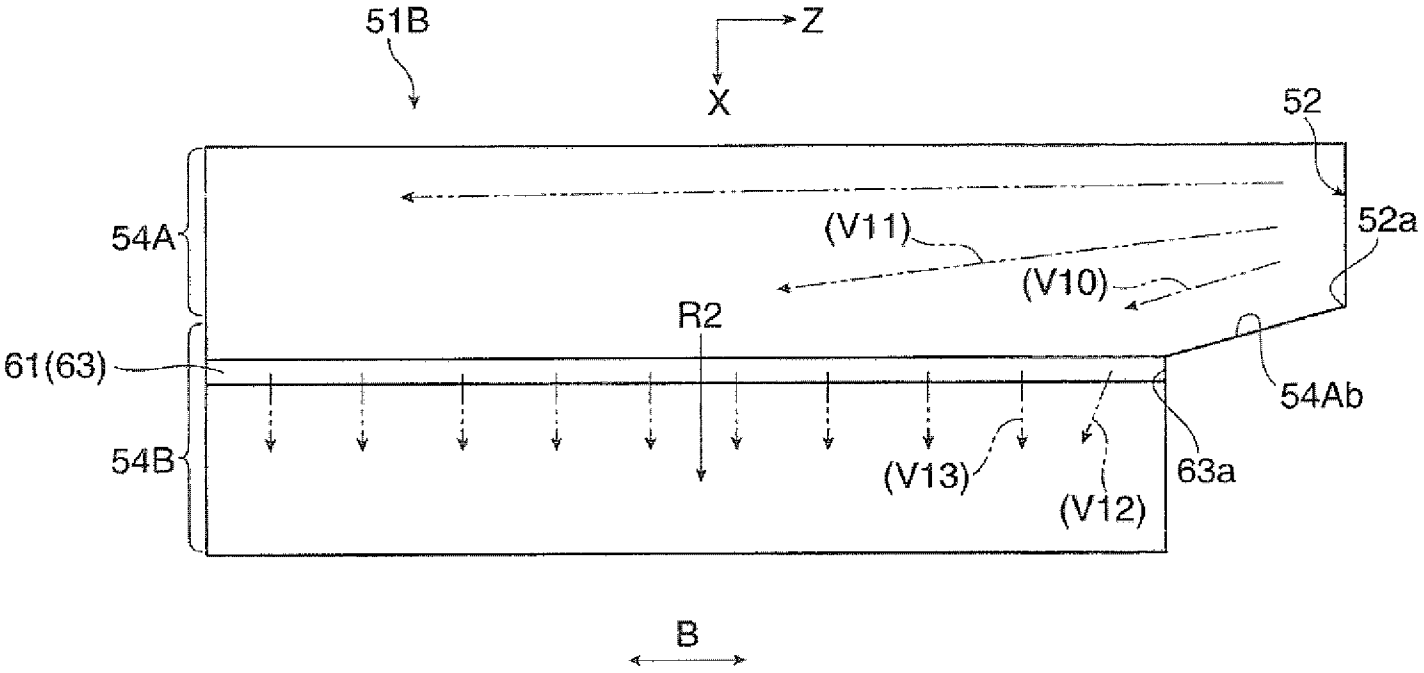
FIG. 15 is an explanatory view schematically showing an air flow direction and an air flow state in the blower duct according to Exemplary Embodiment 2.

As schematically illustrated in FIG. 15, it may be inferred that this is caused by a factor that, in the blower duct 51B, a portion (side surface portion) between the inner end portion 52*a* of the inlet 52 and the end portion 61*a* of the most upstream flow control portion 61 near the inlet 52 is formed by the side wall surface 54Ab including one plane as mentioned above, and thereby the bent angular portion 54K shown above is no longer present, and consequently, the passage space 54*a* widens gradually from the inlet 52 toward the end portion 61*a* of the most upstream flow control portion 61 near the inlet 52.

That is, the air taken in from the inlet 52 flows not only with a straight-ahead component that goes straight along the direction of the coordinate axis Z from the beginning, as shown by two-dot chain lines V10 and V11 with an arrow in FIG. 15, in the stage of flowing so as to travel in the introduction passage portion 54A, but also a component in a direction that flows so as to run along the original flow direction R2 of air in the first bent passage portion 54B. Thereby, as for the air when entering the elongated gap 63 in the most upstream flow control portion 61 so as to pass through the gap, the straight-ahead component that tries to go straight in the direction of the coordinate axis Z in the introduction passage portion 54A is further weakened compared to the case of the blower duct 51 according to Exemplary Embodiment 1, and the flowing direction of the air is changed so as to run along the original flow direction R2 of air in the first bent passage portion 54B. As a result, it is considered this is because the air that passes through the gap 63 in the most upstream flow control portion 61 passes through a portion near the end portion 63*a* of the gap 63 near the inlet 52 much more (refer to two-dot chain lines V12 and V13 with an arrow), and finally relative weakening of the wind speed at the end portion 53*a* of the outlet 53 near the inlet 52 is further reduced.

Exemplary Embodiment 3

Figure 16:
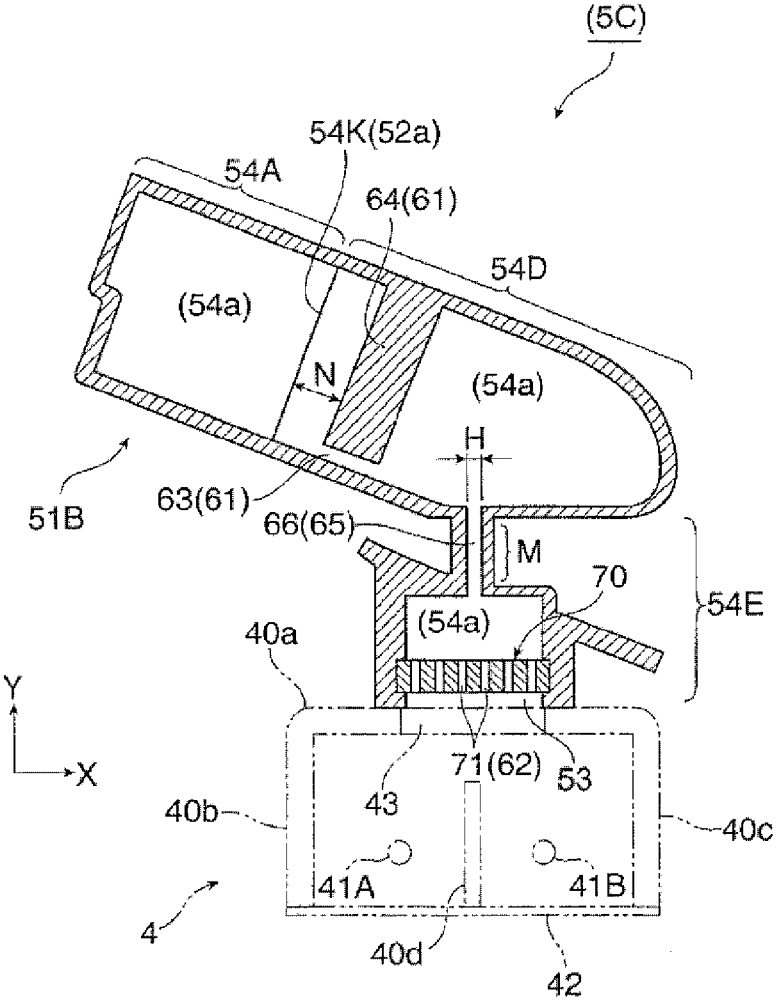
FIG. 16 is an explanatory view showing a blowing device (blower duct) according to Exemplary Embodiment 3.

FIG. 16 shows a blowing device according to Exemplary Embodiment 3, and shows a blower duct 51C in the blowing device (5C).

The blowing device (5C) has the same configuration as the blowing device 5 according to Exemplary Embodiment 1 except that a change is made so that the blower duct 51C with a partially different configuration is used. The blower duct 51C, as shown in FIG. 16, has the same configuration as the blower duct 51 according to Exemplary Embodiment 1 except that the first bent passage portion 543 and the second bent passage portion 54C in Exemplary Embodiment 1 are changed to a first bent passage portion 54D and a second bent passage portion 54E with different configurations, and a third flow control portion 65 is added and changed.

That is, the first bent passage portion 54D of the blower duct 51C is changed in that the first bent passage portion has such a shape that the height of a portion located on the downstream side in the direction in which the air of the passage space 54*a* is caused to flow becomes gradually lower toward the downstream side. Additionally, the second bent passage portion 54E of the blower duct 51B is changed in that the second bent passage portion is formed in the state of being bent in a downward direction from a lower portion that becomes a substantially middle point in the direction in which the air of the first bent passage portion 54D is caused to flow, to a state where the width of the passage space becomes equal, and extending so as to approach the charging device 4, and in that a terminal end of the passage portion 54E is formed with the outlet 53 including almost the same opening shape (oblong shape) as the cross-sectional shape of the passage space 54*a* of the terminal end.

Additionally, the third flow control portion 65 is a portion between the first flow control portion 61 and the most downstream flow control portion 62 in the direction in which the air of the passage space 54*a* is caused to flow, and specifically, is provided in the portion of the second bent passage portion 54E located on the upstream side in the direction in which the air of the passage space 54*a* is caused to flow. Additionally, the flow control portion 65 is configured in a form having a gap 66 in a shape that extends in a direction parallel to the longitudinal direction (B) of the opening shape of the outlet 53.

The flow control portion 65 in Exemplary Embodiment 3 is configured by changing the external shape of the second bent passage portion 54E to a squeezed shape and by forming a shape in which the gap 66 (narrow passage) in a narrowed state is made to be present at a substantially central portion of the passage space 54*a* of the passage portion 54E. Additionally, the height H, path length M, and width W of the gap 66, substantially similarly to the case of the gap 63 in the first flow control portion 61, are selected and set from the viewpoint of making the wind speed of air that flows into the second bent passage portion 54E from the first bent passage portion 54D as uniform as possible, and are set in consideration of the dimensions (capacity) of the duct 51, the flow rate per unit time of air caused to flow to the duct 51, the charging device 4, or the like.

The operation of the blowing device (5C) will be described below.

Figure 17:
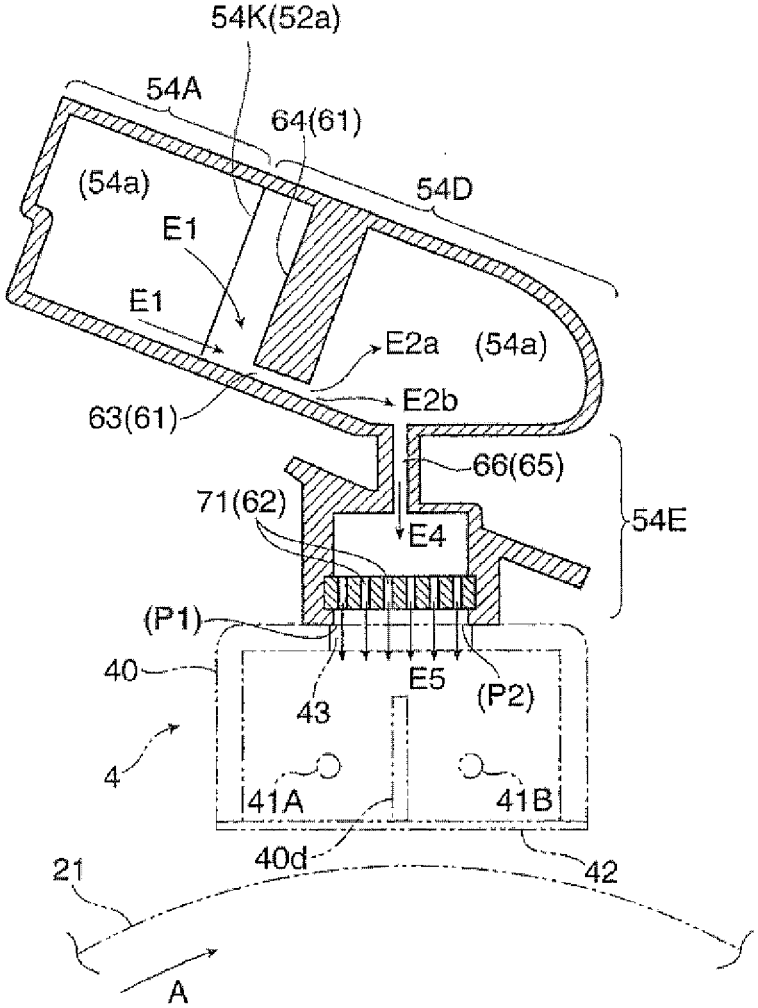
FIG. 17 is an explanatory view showing the state or the like of an operation of the blowing device of FIG. 16.

In the blowing device, the air (E) from the blower 50 taken in through the inlet 52 of the blower duct 51C is taken into the introduction passage portion 54A (refer to the directions of arrow E1 of FIG. 17 or the like), and then sent into the first bent passage portion 54D (refer to the directions of arrows E2*a* and E2*b* of FIG. 17). In this case, the air (E2) that has flowed into the first bent passage portion 54D passes through the gap 63 in the first flow control portion 61, and is thereby brought into almost the same state as the case of the air (E2) that has flowed into the first bent passage portion 54B in Exemplary Embodiment 1.

Subsequently, the air (E2) that has flowed into the second bent passage portion 54D, as shown in FIG. 17, is sent so as to pass through the gap 66 in the third flow control portion 65 provided in the second bent passage portion 54E and flow into the passage space 54*a* of the passage portion 54E (refer to the directions of arrow E4 of FIG. 17).

In this case, the air (E4) when passing through the gap 66 of the flow control portion 65 and flowing into the second bent passage portion 545 has its flow controlled by the flow control portion 65 (the pressure of the air is brought into a raised state), and flows out of the gap 66 in a uniform state. Moreover, as for the air (E4) when flowing into the passage space 54*a* of the second bent passage portion 54E, the direction of the air when flowing out of the gap 66 of the flow control portion 65 is more reliably aligned with a direction substantially orthogonal to the longitudinal direction (B) of the outlet 53. Additionally, the air (E4) that has flowed into the passage space 54*a* of the second bent passage portion 54E is stagnated within the passage space 54*a* of the second bent passage portion 54E whose volume is larger than the passage space 54*a* of the first bent passage portion 54D or the space of the gap 66, and the unevenness of the wind speed is further reduced.

Finally, the air (E4) that has flowed into and stagnated in the second bent passage portion 54E, as shown in FIG. 17, passes through the plural ventilation portions (holes) 71 in the permeable member 70 that constitutes the most downstream flow control portion 62 provided at the termination end (a region slightly further toward the upstream side in the direction in which air is caused to flow than the outlet 53) of the second bent passage portion 54E, and is thereby blown out from the outlet 53 (refer to the direction, length, or the like of the arrow E5 of FIG. 17).

In this case, the air (E5) blown out from the outlet 53 passes through the plural ventilation portions 71 in the permeable member 70 that is relatively narrower than the opening area of the outlet 53, and is thereby sent out in a state where the flow thereof is controlled (at this time, the pressure of the air is brought into a raised state). Additionally, the air (E5) that is blown out from the outlet 53 passes through the plural ventilation portions 71 that are dotted over the whole opening region of the outlet 53 and formed on the same conditions, whereby the air is sent out from the outlet 53 in a uniform state so as to be equivalent to the surface of a region substantially similar to the opening shape of the outlet 53. Moreover, the air (E3) blown out from the outlet 53 is sent out along the direction substantially orthogonal to the longitudinal direction of the outlet 53.

From the above, the air (E5) that comes out of the plural ventilation portions 71, respectively, of the permeable member 70 is sent out in a state where the traveling direction thereof becomes the direction substantially orthogonal to the longitudinal direction of the outlet 53, and the wind speed thereof is brought into a substantially uniform state. Additionally, the wind speed of the air (E3) that comes out from the outlet 53 is brought into a substantially uniform state in the longitudinal direction (B) of the opening shape (oblong shape) of the outlet 53, and is brought into a substantially uniform state also in the lateral direction C.

Moreover, the aforementioned arrangement of the most upstream flow control portion 61 reduces relative weakening of the wind speed of the air that is finally discharged from the outlet 53 at the end portion 53*a* of the outlet 53 near the inlet 52 in the longitudinal direction (B) of the outlet. Thereby, the air discharged from the outlet 53 is discharged in a state where the unevenness of the wind speed in the whole region in the longitudinal direction of the outlet 53 is further reduced.

Then, the air (E5) sent out from the outlet 53 of the blower duct 51, as shown in FIG. 17, is blown into the case 40 through the opening 43 formed in the top face 40*a* of the shielding case 40 of the charging device 4, and is blown against the two corona discharge wires 41A and 41B present inside the case 40 and the grid electrode 42 present in the lower opening of the case 40, respectively.

At this time, since the air blown against the corona discharge wires 41A and 41B and the grid electrode 42, substantially similarly to the case of Exemplary Embodiment 1, comes out from the outlet 53 at a substantially uniform wind speed in both the directions of the longitudinal direction and the lateral direction of the outlet 53 of the blower duct 51, the air is also blown against the two discharge wires 41A and 41B and grid electrode 42 in a substantially equal state. Additionally, since the blown air comes out of the outlet 53 in a state where relative weakening of the wind speed at the end portion 53*a* of the outlet 53 of the blower duct 51 near the inlet 52 in the longitudinal direction (B) of the outlet is reduced, air is also blown against the regions of the two discharge wires 41A and 41B and the grid electrode 42 that face the end portion 53*a* of the outlet at a substantially same wind speed as the other regions.

As a result, in the charging device 4 in which the blowing device (5B) is provided together, degradation, such as unevenness, may be prevented from occurring in charging performance owing to sparse adhesion of unnecessary substances to the discharge wires 41A and 41B or the grid electrode 42, and the peripheral surface of the photoconductor drum 21 can be more uniformly (uniformly in both directions of the axial direction and the circumferential direction along the rotational direction A) charged. Additionally, a toner image formed in the image forming unit 20 including the charging device 4, and an image finally formed on a sheet 9 are obtained as excellent images in which occurrence of image defects (uneven density or the like) resulting from charging defects, such as uneven charging, is reduced.

Test

Figure 18:
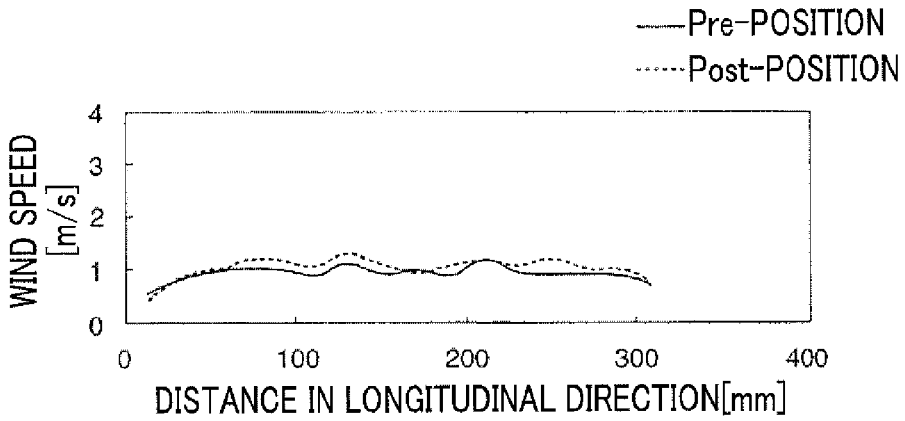
FIG. 18 is a graph chart showing the results of an evaluation test when a wind-speed state at an outlet of the blower duct in the blowing device according to Exemplary Embodiment 3 is measured.

FIG. 18 shows the results of an evaluation test when the performance characteristics (wind speed distribution at the outlet 53 of the blower duct 51C) of the blowing device (5C) are investigated. The test is performed similarly to the case of the test in Exemplary Embodiment 1.

As the blower duct 51C, there is a blower duct in which the overall shape is shown in FIG. 16, and similarly to the blower duct 51 in the blowing device 5 of Exemplary Embodiment 1, a blower duct in which the inlet 52 has a substantially square opening shape of 22 mm×23 mm, and the outlet 53 has an oblong opening shape of 17.5 mm×350 mm is used. Additionally, the most upstream flow control portion 61 is configured so that the shift dimension N to the downstream side that becomes the arrangement position of the partition member 64 is 6 mm, the height H of the gap 63 is a dimension that inclines within a range of 1 to 2 mm, the path length M becomes 6 mm, and the width W becomes 345 mm. Additionally, the flow control portion 65 is configured so that the height H of the gap 66 becomes 1 mm, the path length M becomes 10 mm, and the width W becomes 345 mm. Moreover, the most downstream flow control part 62, similarly to the control unit 62 in Exemplary Embodiment 1, is configured using the porous member 70 in which the ventilation holes 71 with a hole diameter of 1 mm and a length of 3 mm are provided on the condition that the density of the holes becomes 0.42 holes/mm$^2$ (≈42 holes/cm$^2$).

As shown in FIG. 18, the wind speed in the longitudinal direction (B) of the outlet 53 of this blower duct 51C becomes a value near to about 1.0 m/sec that is the mean wind speed of a target value substantially over the whole region. Additionally, it turns out that the results of the respective wind speeds at the pre-position 21 and the post-position P2 of the outlet 53 are the almost same value in the longitudinal direction (B) of the outlet 53, and thereby the wind speeds in the lateral direction C of the outlet 53 are also brought into a uniform state. In addition, in the blowing device (5C) of the Exemplary Embodiment, the adoption (an increase in the flow control portion) of the above blower duct 51C enables the wind speed of the air that comes out from the outlet 53 to be brought into a more stable uniform state even if the flow rate of the air taken into the blower duct 51 increases or decreases, as compared to the blowing device 5 (of the blower duct 51) of Exemplary Embodiment 1.

Other Exemplary Embodiments

Figure 19:
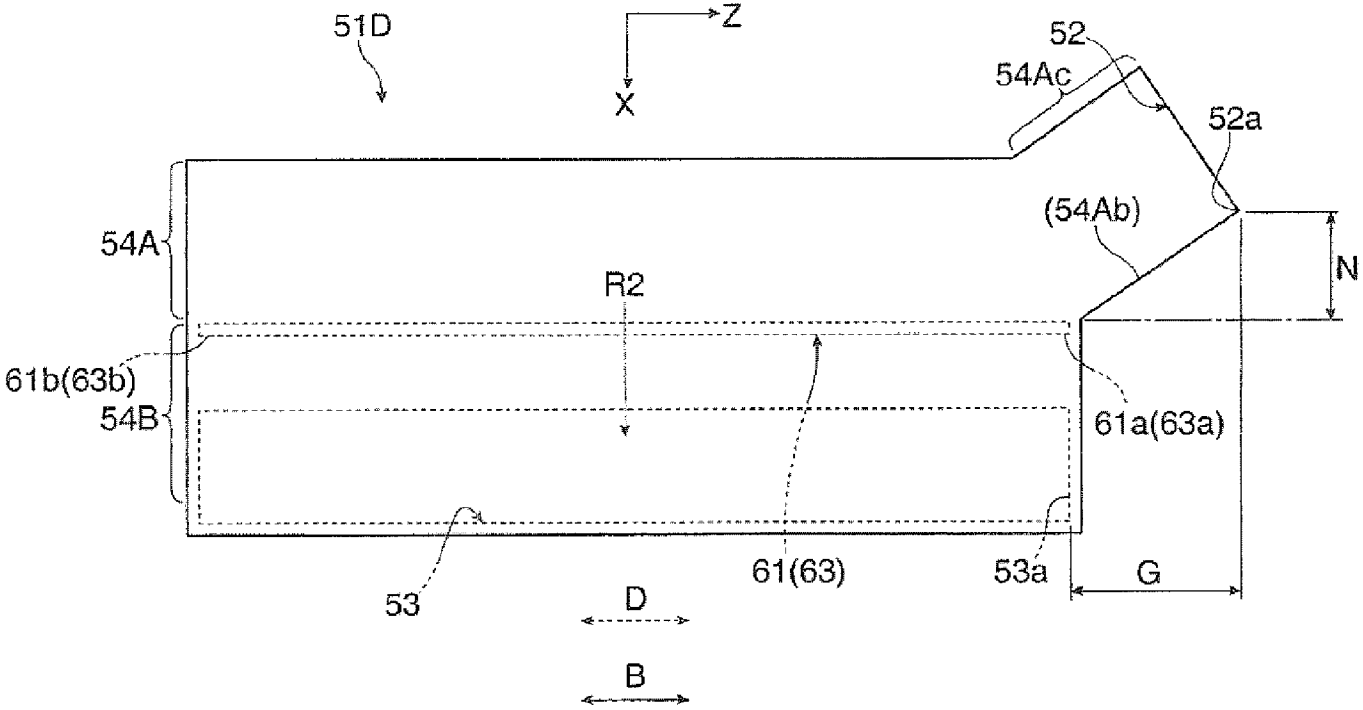
FIG. 19 is a schematic explanatory view showing another configuration example of the blower duct.

The cases where the blower ducts 51, 51A, and 510 in which the introduction passage portion 54A has the structure (the inside of which is hollow prismatic) that is straight as a whole are applied as blower ducts are shown in Exemplary Embodiment 1 to 3. In addition, however, for example, as shown in FIG. 19, it is also possible to apply a blower duct 51D that is formed in a state where an introduction head portion 54Ac of the introduction passage portions 54A including the inlet 52 protrudes so as to be bent in a direction away from the outlet 53. The cross-sectional shape of a body portion of the introduction passage portion 54A excluding the introduction head portion 54Ac in the blower duct 510 and the cross-sectional shape of the passage space 54*a* have the same shape as each other. Additionally, the inlet 52 is formed in a state where the inlet is present so as to protrude by a required dimension G further outward than one end portion 53*a* in the longitudinal direction (B) of the outlet 53 including an elongated opening shape.

Even in the blower duct 51D of such a form, the partition member 64 that constitutes the most upstream flow control portion 61 is provided so that a virtual straight line (two-dot chain line) VL that passes through both the end portions 63*a* and 63*b* of the gap 63 in the crossing direction D is present further toward the downstream side in the flow direction R2 of air that is caused to flow through the first bent passage portion 54B than the inner end portion 52*a* located near the first bent passage portion 54B equivalent to the bent passage space portion of the inlet 52. Additionally, the introduction head portion 54Ac has the structure in which a side surface portion from the inner end portion 52*a* of the inlet 52 to the end portion 61*a* of the most upstream flow control portion 61 near the inlet 52 is formed by a planar side wall surface 54Ab similarly to the case of the side surface portion in the blower duct 51B according to Exemplary Embodiment 2.

Additionally, as the flow control portion in the blower duct 51, the case where two flow control portions 61 and 62 are provided is shown in Exemplary Embodiment 1 and the case where three flow control portions 61, 62, and 65 are provided is shown in Exemplary Embodiment 3. However, four or more flow control portions may be provided. Additionally, it is preferable to provide all the flow control portions also including the downstream flow control portion 62 in a region whose cross-sectional shape is changed in the passage space 54*a* of the passage portion 54 of the duct 51 or in a region after (immediately after or the like) the direction in which air is caused to flow in the passage space 54*a* is changed.

Although the cases where the most downstream flow control portion 62 is configured using the permeable member 70 formed so that the plural ventilation portions (holes) 71 are substantially uniformly dotted over the whole opening region of the outlet 53 are illustrated in Exemplary Embodiments 1 and 3, the most downstream flow control portion 62 may also be configured using the permeable member 70 represented by, for example, porous members (in which the plural ventilation portions 71 are irregular through-gaps), such as a nonwoven fabric applied to filters.

Additionally, the blower duct 51 is not limited to the cases where the overall shapes are those illustrated in Exemplary Embodiments 1 to 3 and the case of the blower duct 51D of the above configuration, and blower ducts having other shapes may be applied. As the blower ducts of other shapes, for example, the blower ducts 510B and 510C illustrated in FIGS. 20B and 20C may also be applied.

In addition, the charging device 4 to which the blowing device 5 (5B) is applied may be a charging device of a type in which the grid electrode 24 is not installed, a so-called corotron type charging device. Additionally, the charging device 4 may be a charging device using one corona discharge wire 41 or three or more corona discharge wires. Additionally, as the target structure to which the blowing device 5 is applied, a corona discharger that performs neutralization of the photoconductor drum 21 or the like, or a corona discharger that charges or neutralizes charged members other than the photoconductor drum may be used. In addition, an elongated structure that requires blowing-off of air other than the corona discharger may be used.

Additionally, an image forming method or the like is not particularly limited if the image forming apparatus 1 includes an elongated target structure that needs to apply the blowing device 5 (5B, 5C). If necessary, an image forming apparatus that forms an image formed from materials other than developer may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blower pipe comprising:

an inlet port that takes in air;

an outlet port that has an elongated opening shape that is parallel to a longitudinal portion of an elongated target structure in a longitudinal direction and is arranged to face the longitudinal portion of the elongated target structure in the longitudinal direction against which the air taken in from the inlet port is to be blown and is different from the opening shape of the inlet port;

a flow path that connects the inlet port and the outlet port to cause air to flow therethrough and is bent at least in one location; and a plurality of flow control members that are provided in mutually different regions in a direction in which air in the flow path is caused to flow and that control the flow of the air, wherein a flow control member of the plurality of flow control members closest to the inlet port:

(a) cuts off a portion of a bent portion of the flow path while air crossing the portion, (b) makes an elongated gap extending in the longitudinal direction to pass air, (c) satisfies the following condition: when a virtual straight line which passes through both end portions of the elongated gap in the longitudinal direction is drawn, the virtual straight line lies downstream of an extension line of a wall immediately before the flow path is bent, in a flow direction of air that flows through the bent portion, and (d) does not overlap, in the longitudinal direction, with the wall immediately before the flow path is bent, and wherein the wall immediately before the flow path is bent and configured by a plane, the plane being inclined with respect to the virtual straight line.

2. The blower pipe according to claim 1, where e inlet port is formed in a state where the inlet port is present outside one end portion of the outlet port in the longitudinal direction of the outlet port, and wherein the portion of the flow path between the inner end portion of the inlet port and the end of the most upstream flow control member near the inlet port is formed by a curved side wall surface.

3. The blower pipe according to claim 2, wherein one of the plurality of flow control members other than the most upstream flow control member is provided as a most downstream flow control member that brings the outlet port into a closed state by a permeable member dotted with a plurality of ventilation portions.

4. The blower pipe according to claim 2, wherein the target structure is a corona discharger.

5. The blower pipe according to claim 1, wherein the inlet port is formed in a state where the inlet port is present outside one end portion of the outlet port in the longitudinal direction of the outlet port, and wherein the portion of the flow path between the inner end portion of the inlet port and the end of the most upstream flow control member near the inlet port is formed by a side wall surface including one plane.

6. The blower pipe according to claim 5, wherein one of the plurality of flow control members other than the most upstream flow control member is provided as a most downstream flow control member that brings the outlet port into a closed state by a permeable member dotted with a plurality of ventilation portions.

7. The blower pipe according to claim 5, wherein the target structure is a corona discharger.

8. The blower pipe according to claim 1, wherein one of the plurality of flow control members other than the most upstream flow control member is provided as a most downstream flow control member that brings the outlet port into a closed state by a permeable member dotted with a plurality of ventilation portions.

9. The blower pipe according to claim 1, wherein the target structure is a corona discharger.

10. The blower pipe according to claim 1, wherein the flow control member extends from a wall, which is lying on a same surface as one of a wall that extends from the inlet port, in a height direction vertical to both an air flow direction before the bent portion and an air flow direction bent by the bent portion, and wherein a gap side wall opposite to the wall, which the flow control member extends from, is lying on a same surface as one of a wall extends from the inlet port in the height direction.

11. The blower pipe according to claim 1, wherein the inlet port comprises an uppermost surface and a lowermost surface, wherein the flow control member extends in a perpendicular direction from a first wall lying on a plane that extends from the uppermost surface of the inlet port, and wherein the gap is defined between a bottom surface of the upstream flow control member and a second wall that is (i) parallel to the first wall and (ii) lies on the same plane as the lowermost surface of the inlet port.

12. The blower pipe according to claim 1, wherein the upstream flow control member extends downward from a top portion of a first bent passage portion.

13. The blower pipe according to claim 1, wherein a portion of the flow path between the inlet port and the bent portion is expanded toward the bent portion.

14. The blower pipe according to claim 1, wherein the target structure comprises a first target structure and a second target structure, which are separated by a partition wall, the partition wall being arranged directly under the output port.

15. A blowing device comprising:

a blower that sends air; and the blower pipe according to claim 1, wherein the air sent from the blower is taken in from the inlet port of the blower pipe.

16. The blowing device according to claim 15, wherein the target structure is a corona discharger.

17. An image forming apparatus comprising:

an elongated target structure against which air is to be blown; and a blowing device that blows air toward a portion of the target structure in the longitudinal direction, wherein the blowing device is the blowing device according to claim 15.

18. The image forming apparatus according to claim 17, wherein the target structure is a corona discharger.

* * * * *